US011565530B2

(12) United States Patent
Fukushima et al.

(10) Patent No.: US 11,565,530 B2
(45) Date of Patent: Jan. 31, 2023

(54) INK CARTRIDGE ADAPTOR, INK CARTRIDGE AND RECORDING APPARATUS

(71) Applicant: CANON KABUSHIKI KAISHA, Tokyo (JP)

(72) Inventors: Takashi Fukushima, Kanagawa (JP); Tetsuya Ohashi, Chiba (JP); Yasuo Kotaki, Kanagawa (JP); Ryoji Inoue, Kanagawa (JP); Koichi Kubo, Kanagawa (JP); Naozumi Nabeshima, Tokyo (JP); Hironori Murakami, Tokyo (JP); Takeho Miyashita, Kanagawa (JP); Kyosuke Nagaoka, Tokyo (JP); Noriyasu Nagai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/272,588

(22) PCT Filed: Sep. 26, 2019

(86) PCT No.: PCT/JP2019/039030
§ 371 (c)(1),
(2) Date: Mar. 1, 2021

(87) PCT Pub. No.: WO2020/067581
PCT Pub. Date: Apr. 2, 2020

(65) Prior Publication Data

US 2021/0316554 A1 Oct. 14, 2021

(30) Foreign Application Priority Data

Sep. 28, 2018 (JP) ..... JP2018-184604

(51) Int. Cl.
*B41J 2/175* (2006.01)

(52) U.S. Cl.
CPC ..... *B41J 2/17526* (2013.01); *B41J 2/1752* (2013.01)

(58) Field of Classification Search
CPC .. B41J 2/17503; B41J 2/17509; B41J 2/1752; B41J 2/17523; B41J 2/17526; B41J 2/17553
See application file for complete search history.

(56) References Cited

U.S. PATENT DOCUMENTS 5,425,478 A 6/1995 Kotaki et al. ..... 222/501
5,430,471 A 7/1995 Nakajima et al. ..... 347/87
(Continued)

FOREIGN PATENT DOCUMENTS

CN 103373077 10/2013
CN 1033862876 6/2014
(Continued)

OTHER PUBLICATIONS

International Search Report and Written Opinion in counterpart PCT/JP2019/039030.
(Continued)

*Primary Examiner* — Anh T Vo
(74) *Attorney, Agent, or Firm* — Venable LLP

(57) ABSTRACT

An ink cartridge adapter or ink cartridge includes a casing; and a plurality of pad electrodes mounted on the casing so as to be movable in a direction outwardly away from a side surface of the casing.

10 Claims, 24 Drawing Sheets

(56) References Cited

U.S. PATENT DOCUMENTS 5,567,373 A 10/1996 Sato et al. ..... 264/112
5,583,549 A 12/1996 Ujita et al. ..... 347/86
5,589,862 A 12/1996 Ujita et al. ..... 347/87
5,608,437 A 3/1997 Iwata et al. ..... 347/86
5,619,237 A 4/1997 Inoue et al. ..... 347/86
5,619,239 A 4/1997 Kotaki et al. ..... 347/86
5,742,310 A 4/1998 Kotaki ..... 347/86
5,781,213 A 7/1998 Ujita et al. ..... 347/86
5,805,188 A 9/1998 Nakajima et al. ..... 347/87
5,815,184 A 9/1998 Ujita et al. ..... 347/87
5,852,457 A 12/1998 Kotaki et al. ..... 347/86
5,929,885 A 7/1999 Nakajima et al. ..... 347/87
5,988,804 A 11/1999 Kotaki et al. ..... 347/87
6,070,974 A 6/2000 Kotaki et al. ..... 347/86
6,116,722 A 9/2000 Sato et al. ..... 347/85
6,145,975 A 11/2000 Kotaki et al. ..... 347/87
6,170,939 B1 1/2001 Ujita et al. ..... 347/86
6,243,116 B1 6/2001 Kotaki et al. ..... 347/86
6,336,709 B1 1/2002 Inoue et al. ..... 347/49
6,338,546 B1 1/2002 Kotaki et al. ..... 347/49
6,361,158 B1 3/2002 Inoue et al. ..... 347/86
6,390,612 B1 5/2002 Kotaki et al. ..... 347/85
6,419,350 B1 7/2002 Abe et al. ..... 347/86
6,421,623 B1 7/2002 Furukawa et al. ..... 702/100
6,623,104 B1 9/2003 Kotaki et al. ..... 347/49
6,685,296 B2 2/2004 Mochizuki et al. ..... 347/19
6,719,394 B2 4/2004 Kubota et al. ..... 347/19
6,719,416 B2 4/2004 Anma et al. ..... 347/86
6,742,881 B2 6/2004 Kotaki et al. ..... 347/86
6,773,099 B2 8/2004 Inoue et al. ..... 347/86
6,827,411 B2 12/2004 Kubota et al. ..... 347/7
6,827,431 B2 12/2004 Kitabatake et al. ..... 347/86
6,830,324 B2 12/2004 Ogura et al. ..... 347/86
6,854,836 B2 2/2005 Ishinaga et al. ..... 347/85
6,869,158 B2 3/2005 Kojima et al. ..... 347/19
6,877,847 B2 4/2005 Hayashi et al. ..... 347/86
6,916,085 B2 7/2005 Kotaki et al. ..... 347/49
6,935,739 B2 8/2005 Inoue et al. ..... 347/104
6,942,326 B2 9/2005 Hayashi et al. ..... 347/86
6,959,984 B2 11/2005 Ogura et al. ..... 347/86
6,966,631 B2 11/2005 Matsuo et al. ..... 347/49
6,969,161 B2 11/2005 Kuwabara et al. ..... 347/85
6,976,753 B2 12/2005 Kuwabara et al. ..... 347/86
6,997,535 B2 2/2006 Mochizuki et al. ..... 347/19
6,997,548 B2 2/2006 Matsuo et al. ..... 347/86
7,004,575 B2 2/2006 Inoue et al. ..... 347/86
7,014,287 B2 3/2006 Kubota et al. ..... 347/7
7,077,514 B2 7/2006 Inoue et al. ..... 347/86
7,086,725 B2 8/2006 Ogura et al. ..... 347/86
7,104,640 B2 9/2006 Ogura et al. ..... 347/86
7,111,931 B2 9/2006 Amma et al. ..... 347/86
7,118,194 B2 10/2006 Matsuo et al. ..... 347/49
7,125,109 B2 10/2006 Watanabe et al. ..... 347/86
7,128,407 B2 10/2006 Inoue et al. ..... 347/85
7,134,747 B2 11/2006 Hayashi et al. ..... 347/86
7,165,829 B2 1/2007 Hayashi et al. ..... 347/49
7,192,111 B2 3/2007 Matsumoto et al. ..... 347/7
7,210,755 B2 5/2007 Kubota et al. ..... 347/7
7,290,861 B2 11/2007 Inoue et al. ..... 347/49
7,311,388 B2 12/2007 Ogura et al. ..... 347/87
7,350,910 B2 4/2008 Amma et al. ..... 347/86
7,360,876 B2 4/2008 Inoue et al. ..... 347/85
7,384,116 B2 6/2008 Kotaki et al. ..... 347/19
7,396,118 B2 7/2008 Ogawa et al. ..... 347/87
7,401,909 B2 7/2008 Inoue et al. ..... 347/86
7,407,274 B2 8/2008 Inoue et al. ..... 347/86
7,407,275 B2 8/2008 Inoue et al. ..... 347/86
7,517,067 B2 4/2009 Inoue et al. ..... 347/85
7,607,770 B2 10/2009 Inoue et al. ..... 347/85
7,726,792 B2 6/2010 Fukushima et al. ..... 347/86
7,735,984 B2 6/2010 Iijima et al. ..... 347/86
7,784,927 B2 8/2010 Inoue et al. ..... 347/86
7,914,137 B2 3/2011 Inoue et al. ..... 347/86
7,922,274 B2 4/2011 Kubota et al. ..... 347/7
7,926,927 B2 4/2011 Kotaki et al. ..... 347/86
7,950,790 B2 5/2011 Kubo et al. ..... 347/86
7,954,931 B2 6/2011 Shimizu et al. ..... 347/85
8,020,978 B2 9/2011 Ogawa et al. ..... 347/86
8,047,641 B2 11/2011 Nanjo et al. ..... 347/86
8,091,995 B2 1/2012 Shimizu et al. ..... 347/86
8,109,617 B2 2/2012 Kotaki et al. ..... 347/86
8,123,342 B2 2/2012 Ujita et al. ..... 347/86
8,136,930 B2 3/2012 Anma et al. ..... 347/86
8,141,998 B2 3/2012 Nozawa et al. ..... 347/86
8,205,974 B2 6/2012 Ogura et al. ..... 347/86
8,240,826 B2 8/2012 Fukushima et al. ..... 347/86
8,313,185 B2 11/2012 Hatasa et al. ..... 347/92
8,322,807 B2 12/2012 Seki et al. ..... 347/6
8,346,105 B2 1/2013 Takahashi et al. ..... 399/12
8,425,022 B2 4/2013 Inoue et al. ..... 347/86
8,469,498 B2 6/2013 Ohashi et al. ..... 347/86
8,529,037 B2 9/2013 Miyashita et al. ..... 347/86
8,550,607 B2 10/2013 Inoue et al. ..... 347/86
8,616,687 B2 * 12/2013 Takagi ..... B41J 2/1753 347/86
8,660,441 B2 2/2014 Takahashi et al. ..... 399/12
8,770,730 B2 7/2014 Nanjo et al. ..... 347/86
8,770,731 B2 7/2014 Miyashita et al. ..... 347/86
8,864,292 B2 10/2014 Kanbe et al. ..... 347/86
8,960,869 B2 2/2015 Takada et al. ..... 347/86
8,985,743 B2 3/2015 Sasaki ..... 347/49
9,016,842 B2 4/2015 Miyashita et al. ..... 347/86
9,278,540 B2 3/2016 Seki et al. ..... B41J 2/1752
9,333,758 B2 5/2016 Koshikawa et al. ... B41J 2/1752
9,375,938 B2 6/2016 Kondo et al. ..... B41J 2/17513
9,597,884 B2 3/2017 Nanjo et al. ..... B41J 2/17526
9,597,888 B2 3/2017 Takahashi et al. ..... B41J 2/175
9,694,585 B2 7/2017 Shiba et al. ..... B41J 2/17513
9,724,929 B2 8/2017 Yoshii et al. ..... B41J 2/1752
9,821,562 B2 11/2017 Nanjo et al. ..... B41J 2/17523
9,840,082 B2 12/2017 Nanjo et al. ..... B41J 2/17513
9,908,338 B2 3/2018 Koshikawa et al. ..... B41J 29/02
9,914,305 B2 3/2018 Orihara et al. ..... B41J 2/17523
9,914,308 B2 3/2018 Yamada et al. ..... B41J 2/1404
9,919,536 B2 3/2018 Miyashita et al. ... B41J 2/17523
9,962,945 B2 5/2018 Takaoka et al. ..... B41J 2/17523
9,975,340 B2 5/2018 Karita et al. ..... B41J 2/14024
9,981,464 B2 5/2018 Karita et al. ..... B41J 2/155
9,981,477 B2 5/2018 Fukuchi et al. ..... B41J 2/17553
9,981,478 B2 5/2018 Ikebe et al. ..... B41J 29/02
10,005,287 B2 6/2018 Yamada et al. ..... B41J 2/14072
10,029,474 B2 7/2018 Takada et al. ..... B01D 19/0073
10,093,105 B2 10/2018 Shimamura et al. ..... B41J 2/17553
10,112,403 B2 10/2018 Ikebe et al. ..... B41J 2/1752
10,160,222 B2 12/2018 Shiba et al. ..... B41J 2/17566
10,195,868 B2 2/2019 Yamada et al. ..... B41J 2/175
10,207,511 B2 2/2019 Nanjo et al. ..... B41J 2/175
10,336,087 B2 7/2019 Miyashita et al. ... B41J 2/17513
10,391,776 B2 8/2019 Hayashi et al. ..... B41J 2/17513
10,399,346 B2 9/2019 Arai et al. ..... B41J 2/175
10,399,347 B2 9/2019 Miyashita et al. ... B41J 2/17506
10,427,412 B2 10/2019 Okude et al. ..... B41J 2/03
10,471,711 B2 11/2019 Karita et al. ..... B41J 2/16585
10,538,092 B2 1/2020 Miyashita et al. ... B41J 2/17523
10,583,662 B2 3/2020 Yamada et al. ..... B41J 2/175
10,611,162 B2 4/2020 Ikebe et al. ..... B41J 2/17523
10,618,300 B2 4/2020 Shimamura et al. ..... B41J 2/17509
10,675,882 B2 6/2020 Shiba et al. ..... B41J 2/17566
10,792,930 B2 10/2020 Yamada et al. ..... B41J 2/165
10,836,175 B2 11/2020 Miyashita et al. ... B41J 2/17553
10,843,474 B2 11/2020 Arai et al. ..... B41J 29/13
10,906,323 B2 2/2021 Nagaoka et al. .... B41J 2/17553
2004/0246304 A1 12/2004 Takahashi et al. ..... 347/49
2005/0007420 A1 1/2005 Ogawa et al. ..... 347/50
2008/0018720 A1 1/2008 Fukushima et al. ..... 347/86
2008/0021170 A1 1/2008 Fukushima et al. ..... 525/340
2008/0106575 A1 5/2008 Shimizu et al. ..... 347/49
2008/0136878 A1 6/2008 Nozawa et al. ..... 347/86
2008/0284810 A1 11/2008 Shimizu et al. ..... 347/20
2012/0200871 A1 8/2012 Takahashi et al. ..... 358/1.9
2013/0050310 A1 2/2013 Seki et al. ..... 347/6
2013/0188985 A1 7/2013 Takahashi et al. ..... 399/110

(56) References Cited

U.S. PATENT DOCUMENTS

| | | | | |
|---|---|---|---|---|
| 2013/0278683 | A1 | 10/2013 | Kanbe et al. | 347/86 |
| 2014/0168324 | A1 | 6/2014 | Sasaki | 347/86 |
| 2016/0059568 | A1* | 3/2016 | Nakata | B41J 2/17546 347/86 |
| 2016/0059569 | A1 | 3/2016 | Takagi et al. | 347/85 |
| 2017/0197426 | A1 | 7/2017 | Nagai et al. | B41J 2/1404 |
| 2020/0198359 | A1 | 6/2020 | Shimamura et al. | B41J 2/17509 |
| 2020/0282729 | A1 | 9/2020 | Inoue et al. | B41J 2/175 |

FOREIGN PATENT DOCUMENTS

| | | |
|---|---|---|
| CN | 105722684 | 6/2016 |
| EP | 2 653 313 | 10/2013 |
| EP | 2 980 656 | 2/2016 |
| EP | 3112162 | 1/2017 |
| EP | 3301516 | 4/2018 |
| JP | 2008-273173 | 11/2008 |
| JP | 2012-226288 | 11/2012 |
| JP | 2012-226289 | 11/2012 |
| JP | 2012-226295 | 11/2012 |
| JP | 2012-230343 | 11/2012 |
| JP | 2013-220649 | 10/2013 |
| JP | 2014-117836 | 6/2014 |
| WO | 2017/130242 | 8/2017 |
| WO | 2020/067580 | 4/2020 |

OTHER PUBLICATIONS

Office Action dated Jan. 21, 2022 in counterpart Chinese Application No. 201980062985.1, together with English translation thereof.
U.S. Appl. No. 17/272,600, filed Mar. 1, 2021.
Office Action dated Jun. 28, 2022 in counterpart Japanese Application No. 2018-184604, together with English translation thereof.
Office Action dated Jun. 16, 2022 in counterpart Chinese Application No. 201980062985.1, together with English translation thereof.
Office Action dated Oct. 18, 2022 in counterpart Japanese Application No. 2018-184604, together with English translation thereof.
EPC Communication dated Nov. 10, 2022 in counterpart EP Application No. 19794713.8.

* cited by examiner (a)

(b)

(a)

DT A (b)

DT B

INK CARTRIDGE ADAPTOR, INK CARTRIDGE AND RECORDING APPARATUS

TECHNICAL FIELD

The present invention relates to an ink cartridge adaptor including a pad electrode, an ink cartridge, and a recording apparatus in which the ink cartridge is mounted.

BACKGROUND ART

As a recording apparatus such as an ink jet printer, there is a recording apparatus to which a member (for example, an ink cartridge) including an electrode portion having a pad electrode is mounted. When such a member is mounted to the recording apparatus, the pad electrode of the member becomes in a state that it can be electrically connected to the electrical connecting portion on the recording apparatus side.

Japanese Laid-open Patent Application No. 2008-273173 discloses an ink cartridge provided with a circuit board (pad electrode) including a memory element. When this ink cartridge is mounted to the recording apparatus, a connection terminal of the recording apparatus and the pad electrode of the ink cartridge can be electrically connected.

SUMMARY OF THE INVENTION

Representative structures are as follows.

An ink cartridge adapter comprising: a casing; and plurality of pad electrodes mounted on said casing so as to be movable in a direction outwardly away from a side surface of said casing.

Further features of the present description will be apparent from the following description of the example with reference to the attached drawings.

EMBODIMENTS FOR CARRYING OUT THE INVENTION

According to the investigation by the inventors of the present invention, when the ink cartridge disclosed in Japanese Laid-open Patent Application No. 2008-273173 is mounted in the recording apparatus, if the mounting force is strong, the contact between the connection terminals of the recording apparatus and the pad electrodes of the ink cartridge may not be good enough in some cases.

That is, in the prior art, there is room for improvement on the member (ink cartridges) including the pad electrodes and the recording apparatus to which the member is mounted.

In the following, embodiments of the member, the ink cartridge, and the recording apparatus according to the present invention will be specifically described in conjunction with the drawings. Here, each of the following embodiments is a preferable example for carrying out the present invention, and the present invention is not limited to the structures of such examples. In addition, the contents described in each embodiment can be combined with a part or parts of the description content.

Embodiment 1

First, an example in which an ink jet printer is used as a recording apparatus, and in which an ink cartridge is used as the mountable member will be described.

<Recording Apparatus>

(Overall Structure)

Figure 1:
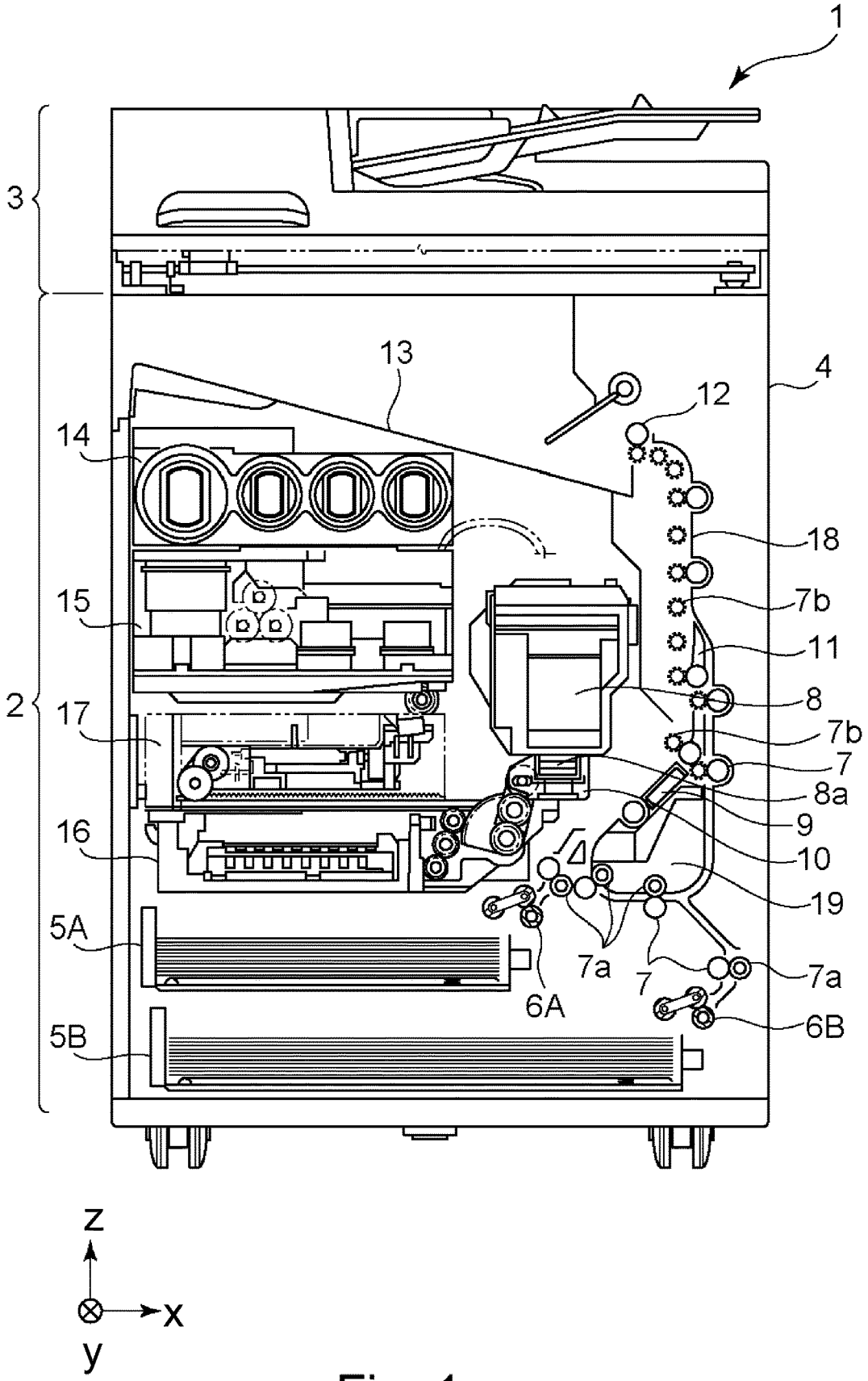
FIG. 1 is an illustration of a structure of an inkjet printer.
Figure 2:
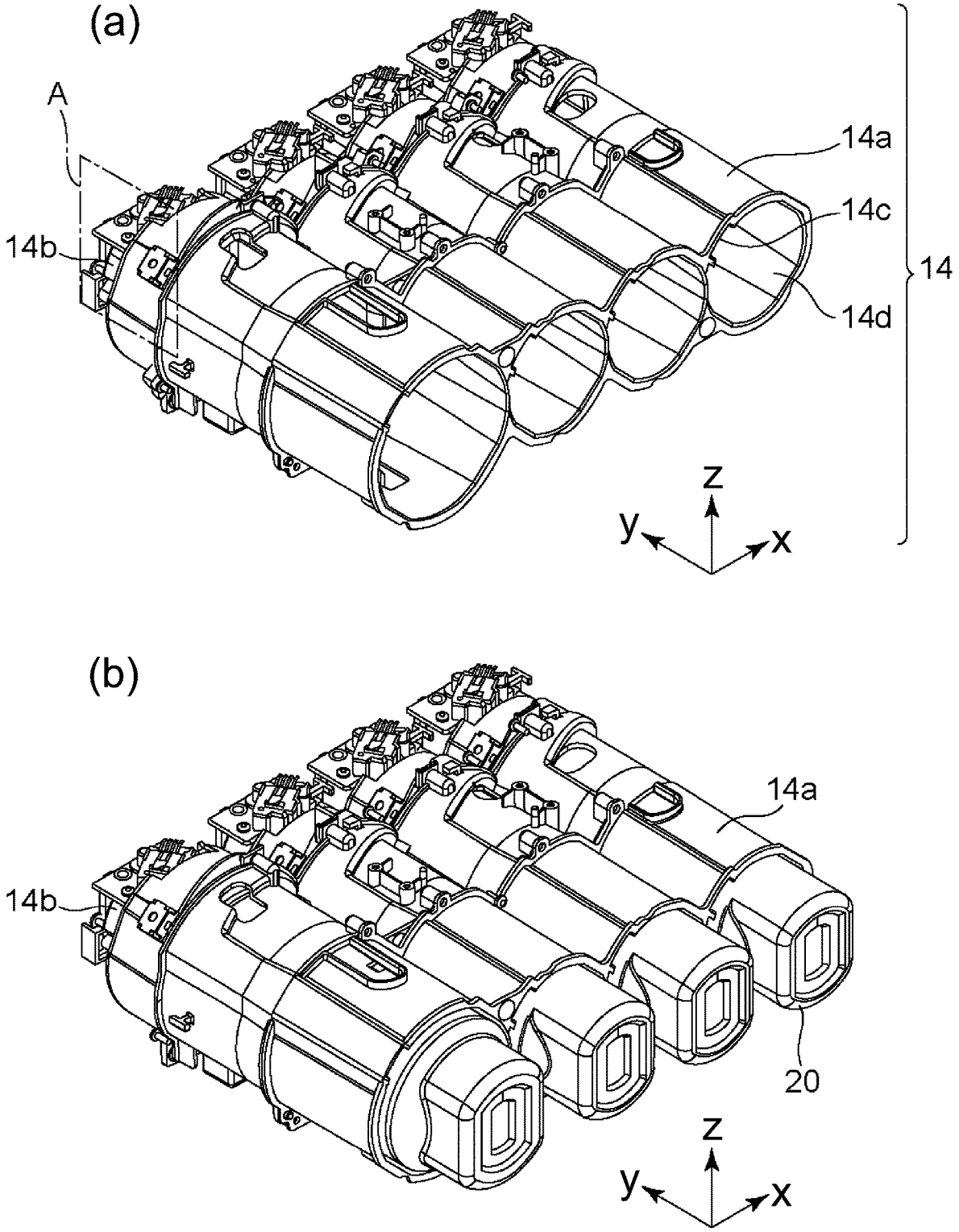
FIG. 2 is an illustration of a structure of a mounting unit.

Referring to FIG. 1, the overall structure of an inkjet printer 1 (hereinafter referred to as a recording apparatus 1) as an example of a recording apparatus will be described FIG. 1 is an internal structure illustration of the recording apparatus 1. In FIG. 1, a x direction indicates the horizontal direction, a y direction (the direction perpendicular to the sheet of the drawing) indicates the direction in which the discharge openings are arranged in the recording head 8 described later, and the z direction indicates the direction of gravity (vertical direction). Here, the x direction, the y direction and the z direction shown in FIG. 1 are usable with the same meaning also in the drawings after FIG. 1. For example, the x direction, the y direction and the z direction shown in Parts (a) and (b) of FIG. 2 are directions same as the x direction, the y direction and the direction shown in FIG. 1, respectively.

The recording apparatus 1 is a multifunction machine including a printing portion 2 and a scanner portion 3 above the printing portion 2, and various processes relating to a recording operation and a reading operation are individually or in interrelation with the printing portion 2 and the scanner portion 3 can be executed. The scanner portion 3 is equipped with ADF (Automatic Document Feeder) and FBS (Flat Bed Scanner), and it is possible to scan originals automatically fed by the ADF and to read originals placed on the platen of the FBS by the user. Here, FIG. 1 shows a multifunction peripheral including both the printing unit 2 and the scanner unit 3, but the scanner unit 3 may not be provided. FIG. 1 shows a state in which the recording apparatus 1 is in a stand-by state in which neither the recording operation nor the reading operation is carried out.

In the printing unit 2, a first cassette 5A and a second cassette 5B for storing a recording material (cut sheet) S are dismountably mounting at a bottom portion of the casing 4 downwardly in the gravity direction. Relatively small recording materials up to A4 size are accommodated in the first cassette 5A and relatively large recording materials up to A3 size are accommodated in the second cassette 5B in the form of a flat stack. In the neighborhood of the first cassette 5A, there is provided a first feeding unit 6A for separating and feeding the stored recording materials one by one. Similarly, in the neighborhood of the second cassette 5B, the second feeding unit 6B is provided. When the recording operation is carried out, the recording material S is selectively fed from one of the cassettes.

A feeding roller 7, a discharge roller 12, a pinch roller 7*a*, a spur 7*b*, a guide 18, an inner guide 19 and a flapper 11 are feeding mechanisms for guiding to feed the recording material S in a predetermined direction. The feeding rollers 7 are disposed on an upstream side and a downstream side of the recording head 8 and are driving rollers driven by a feeding motor (not shown). The pinch roller 7*a* is a driven roller that rotates while nipping the recording material S together with the feeding roller 7. The discharging roller 12 is a driving roller which is disposed on the downstream side of the feeding roller 7 and is driven by a feeding motor (not shown). The spur 7*b* sandwiches and feeds the recording material S together with the feeding roller 7 and the discharge roller 12 provided on the downstream side of the recording head 8.

The guide 18 is provided in the feeding path of the recording material S and guides the recording material S in a predetermined direction. The inner guide 19 extends in the y direction, has a curved side surface, and guides the recording material S along the side surface. The flapper 11 is for switching the direction in which the recording material S is fed during the duplex recording operation. The discharge tray 13 is for stacking and holding the recording materials S discharged by the discharge roller 12 after completion of the recording operation.

The recording head 8 shown in FIG. 1 is a full-line type ink jet recording head, in which ejection openings for injecting ink in accordance with recording data are arranged in the y direction in FIG. 1, and the number of ejection openings are enough to cover width of the recording material S. In addition, it is an inkjet recording head capable of color printing. When the recording head 8 is in the standby position, the ejection opening surface 8*a* of the recording head 8 is capped by the cap unit 10 as shown in FIG. 1. When performing the recording operation, the direction of the recording head 8 is changed by the print controller so that the ejection opening surface 8*a* faces the platen 9. The platen 9 is constituted by a flat plate extending in the y direction, and supports the recording material S on which the recording operation is performed by the recording head 8, at the back side of the recording material S.

The recording head 8 need not necessarily be a full-line type recording head, but may be a serial-scan type recording head that reciprocates in a direction crossing the feeding direction of the recording material S.

A mounting portion 14 is a portion to which the ink cartridge is mounted. The mounting portion 14 may be made dismountable from the recording apparatus 1. Here, in this example, four ink cartridges are mounted on the mounting portion 14, and these ink cartridges store the four colors of ink to be supplied to the recording head 8, respectively. The ink supply unit 15 is provided in the middle of a flow path connecting the mounting portion 14 and the recording head 8 and adjusts the pressure and the flow rate of the ink in the recording head 8 to appropriate levels. In addition, in this example, a circulation type ink supply "system" is employed, and the ink supply unit 15 adjusts the pressure of the ink supplied to the recording head 8 and the flow rate of the ink returning from the recording head 8 within appropriate ranges.

The maintenance unit 16 includes a cap unit 10 and a wiping unit 17 and operates at a predetermined timing to perform a maintenance operation on the recording head 8.

Here, "ink" as used herein includes any liquid that can be used for image formation or processing of a recording material by being applied to a recording material. Therefore, "ink" as used herein includes any liquid that can be used for recording. In addition, the recording is not limited in particular, and it can be applied to industrial applications and the like. For example, they can be used for biochip production, electronic circuit printing, semiconductor substrate production, and so on.

(Mounting Portion)

Parts (a) and (b) of FIG. 2 shows a view of the mounting portion 14 of the recording apparatus 1 of FIG. 1 as viewed obliquely from above in the direction of gravity, in which the mounting portion 14 is omitted. Part (a) of FIG. 2 is an illustration showing a state before the ink cartridge is mounted to the mounting portion 14. Part (b) of FIG. 2 is an illustration showing a state after the ink cartridge 20 is mounted to the mounting portion 14.

The mounting portion 14 shown in Parts (a) and (b) of FIG. 2 includes four cylindrical hole forming members 14*a*. Each hole forming member 14*a* forms a hole 14*d*. The ink cartridge 20 is inserted into the hole 14*d* formed by the hole forming member 14*a* of the mounting portion 14 and mounted to the mounting portion 14 of the recording apparatus. It is not always necessary to provide a plurality of hole forming members 14*a*. For example, one hole forming member may include a plurality of holes. It is preferred that the diameter of the hole 14*d* (the dimension measured in the direction perpendicular to the extending direction of the hole 14*d*) is 50 mm or more and 90 mm or less. Here, if the cross-section taken in the direction perpendicular to the extending direction of the hole 14*d* is not a perfect circle, the diameter of the hole 14*d* is assumed to be the circle equivalent diameter. Similarly, in the present specification, the "equivalent diameter" is taken as "diameter" unless otherwise specified.

On the back side of the hole forming member 14*a*, another hole forming member 14*b* different from the hole forming member 14*a* is provided. When mounting the ink cartridge, the side where the hole forming member 14*a* is provided is the front side, and the side provided with the hole forming member 14*b* is the rear side. The hole forming member 14*b* is also provided with a hole (not shown in Parts (a) and (b)

of FIG. 2), and the hole 14*d* of the hole forming member 14*a* and the hole of the hole forming member 14*b* communicate with each other inside the mounting portion 14. The ink cartridge 20 is inserted into this communicated hole. Here, the hole forming member 14*a* and the hole forming member 14*b* may not be provided as separate members, and, for example, two hole forming members may be integrated. Examples of materials for forming the hole forming member 14*a* include ABS (acrylonitrile-butadiene-styrene copolymer resin), PPO (modified polyphenylene oxide), HIPS (high impact polystyrene resin), and the like. Materials for forming the hole forming member 14*b* include PE (polyethylene), PP (polypropylene), PPO (modified polyphenylene oxide), and the like.

At the opening on the front side of the hole 14*d* of the hole forming member 14*a*, an ID recess 14*c* is provided. The ID recess 14*c* is used for roughly aligning the ink cartridge 20 relative to the mounting portion 14 when the ink cartridge 20 is mounted. In Parts (a) and (b) of FIG. 2, the circular opening of the hole 14*d* is partially recessed to form the ID recess 14*c*.

A plurality of electrical connecting portions (not shown in Parts (a) and (b) of FIG. 2) are provided in the mounting portion 14 so as to be in contact with the respective pad electrodes of the ink cartridge and to be electrically connected with the pad electrodes by physical contact therebetween. In Parts (a) and (b) of FIG. 2, the electrical connecting portion is provided in the hole forming member 14*b* of the mounting portion 14.

Figure 3:
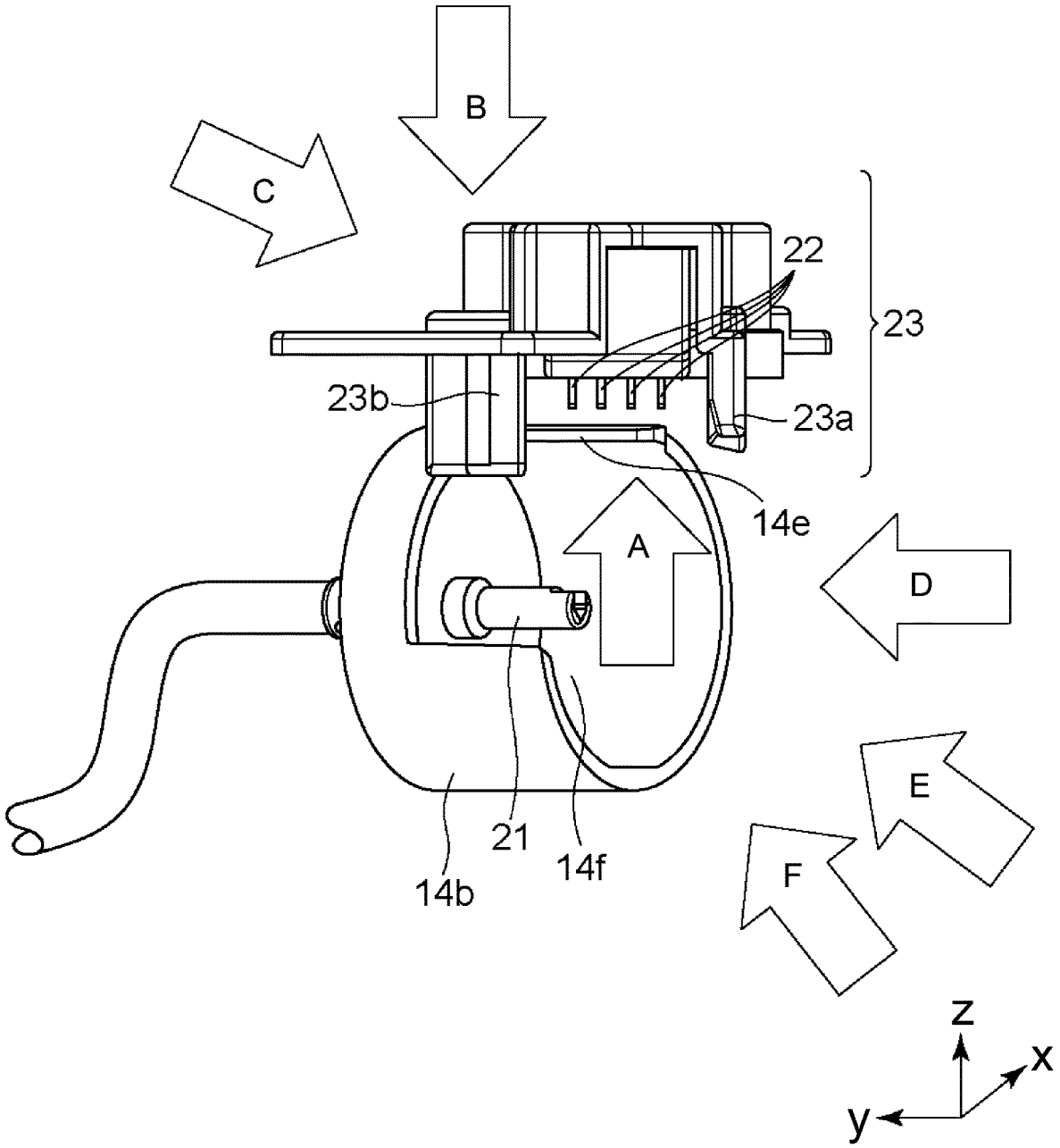
FIG. 3 is an illustration showing a structure around an electrical connecting portion of the mounting portion.

FIG. 3 schematically is an enlarged view of the hole forming member 14*b* around the electrical connecting portion. FIG. 3 is a view of a cross portion of the mounting portion 14 (hole forming member 14*b*) in a portion surrounded by a portion A in part (a) of FIG. 2. Here, in FIG. 3, a part of the mounting portion 14 including the hole forming member 14*a* is omitted, for simplicity of illustration.

As shown in FIG. 3, the hole forming member 14*b* is a tubular member, and a hole 14*f* is formed inside the hole forming member 14*b*. The tubular ink receiving tube 21 projects from the rear side surface of the hole 14*f* (the bottom surface of the hole 14*f* formed by the hole forming member 14*b*). The surface on the rear side of the hole 14*f* is circular, and the ink receiving tube 21 projects from a center of the circular surface in a direction (extending direction) perpendicular to the surface. The ink receiving tube 21 is a tube for receiving the ink supplied from the ink cartridge mounted to the mounting portion 14. The ink receiving tube 21 is connected to the recording head of the recording apparatus by way of the ink flow path, and supplies the ink received from the ink cartridge to the recording head. One ink receiving tube corresponds to one color ink. Therefore, it is preferable to provide ink receiving tubes for the ink color used, respectively. Examples of materials forming the ink receiving tube 21 include SUS (stainless steel), PPO (modified polyphenylene oxide) and the like. It is preferred that the diameter of the ink receiving tube 21 (the diameter in the cross-section perpendicular to the extending direction of the ink receiving tube 21) is 2 mm or more and 5 mm or less. Further preferably, it is 3 mm or more and 4 mm or less. Here, it is preferred that the diameter of the hole 14*f* (the diameter measured in the direction perpendicular to the extending direction of the hole 14*f*) is 20 mm or more and 30 mm or less. It is preferred that the diameter of hole 14*f* is smaller than the diameter of hole 14*d*.

As shown in FIG. 3, the mounting portion 14 is provided with a plurality of electrical connecting portions 22. The electrical connecting portion 22 may be in the form of a connector pin or the like. The electrical connecting portion 22 is provided in the electrical connecting portion peripheral portion 23 which is a part of the mounting portion 14. Copper alloy (gold-plated) or the like can be used as a material for forming the electric connecting portion 22. Examples of materials forming the electrical connecting portion peripheral portion 23 include ABS (acrylonitrile-butadiene-styrene copolymer resin), PC (polycarbonate), and the like.

The plurality of electrical connecting portions 22 are interposed between walls 23*a*, 23*b* of the electrical connecting portion peripheral portion 23. The walls 23*a* and 23*b* are opposed to each other with the plurality of electric connecting portions 22 interposed therebetween, and at least one of the walls performs the function as a positioning portion for the electrode portion when mounting the ink cartridge as will be described hereinafter. As the material for forming the positioning walls 23*a* and 23*b*, PPO (modified polyphenylene oxide), ABS (acrylonitrile-butadiene-styrene copolymer resin), SUS (stainless steel) and the like can be used. Here, the electrical connecting portion peripheral part 23 may be dismountably from the mounting portion 14. In addition, the electrical connecting portion peripheral portion 23 may not be provided in the hole forming member 14*b*, but may be provided separately from the hole forming member 14*b*.

Next, the structure of the electrical connecting portion 22 and the electrical connecting portion peripheral portion 23 will be described in more detail. First, the view of the periphery of the electrical connection portion 22 in the direction of the arrow An in FIG. 3 is shown in part (a) of FIG. 4. The direction of the arrow An in FIG. 3 is the direction (z direction) heading from the lower side to the upper side with respect to the direction of gravity in the attitude of using the recording apparatus. The attitude of using the recording apparatus is the attitude in which the recording apparatus is placed when recording is carried out by the recording apparatus, and it is the attitude shown in FIG. 1. Here, "gravity direction" in this specification means the direction of gravity in the attitude in which the recording apparatus is used unless otherwise specified. In the direction of the arrow A, the hole forming member 14*b* and the electrical connecting portion 22 are visible. The hole forming member 14*b* visible here can support the pad electrode of the ink cartridge and can restrict the movement of the pad electrode in the vertical direction (gravity direction). By this restriction of movement, the hole forming member 14*b* serves as a supporting member for stabilizing the mounting of the ink cartridge (In this sense, the hole forming member 14*b* is a supporting member 14*e*). As shown in part (a) of FIG. 4, as viewed in the direction of arrow A, the hole forming member 14*b* covers a part of the electric connecting portion 22. Here, the hole forming member 14*b* is not limited to the form covering a part of the electric connecting portion 22 as shown here, but it may be formed so as not to cover the electric connecting portion 22 is viewed in the direction of part (a) of FIG. 4.

Figure 4:
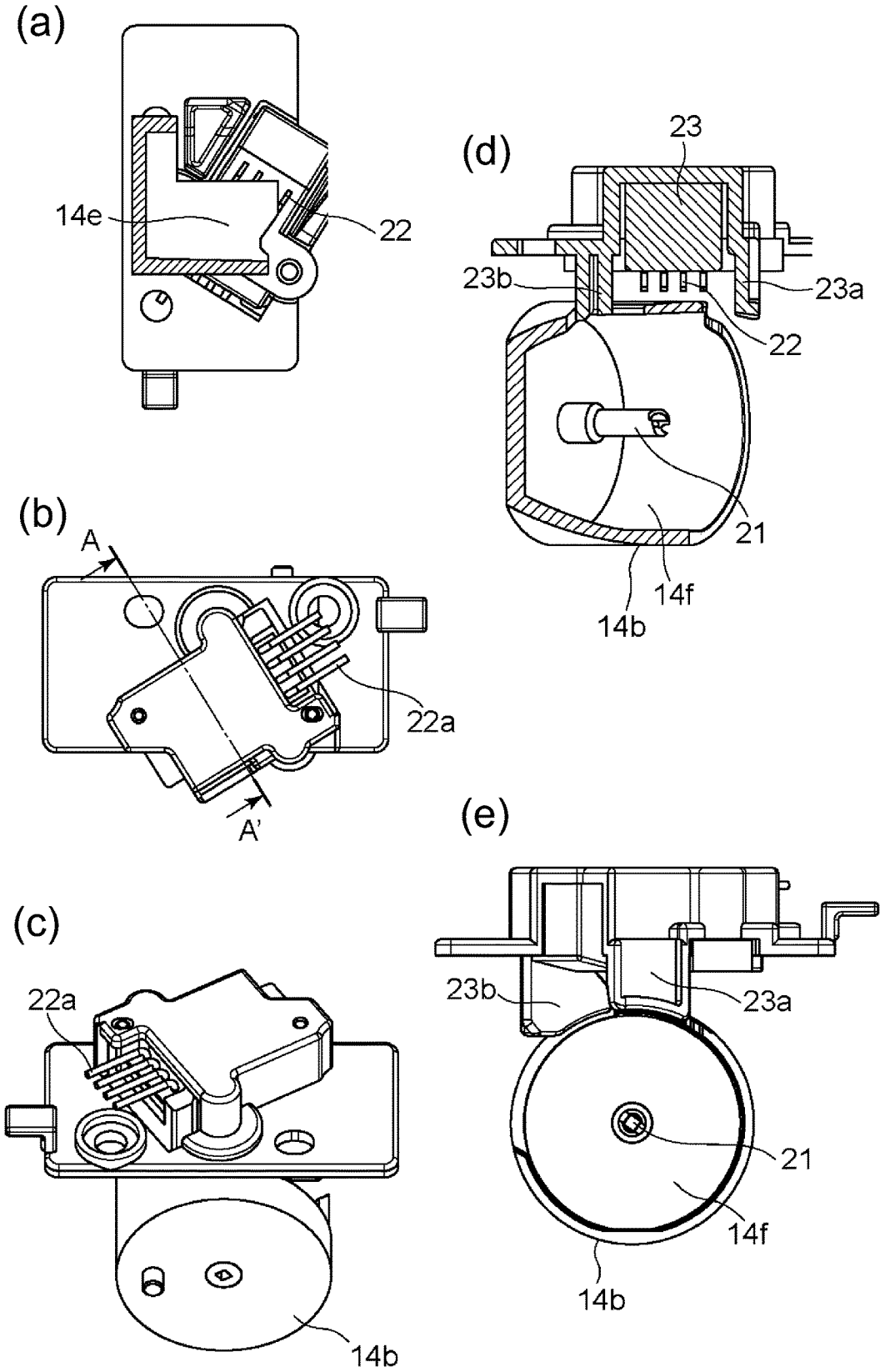
FIG. 4 is an illustration showing a structure around the electrical connecting portion of the mounting portion.

Next, the periphery of the electrical connecting portion 22 as viewed in the direction of the arrow B in FIG. 3 is shown in part (b) of FIG. 4. The direction of the arrow B in FIG. 3 is the direction from the upper side to the lower side with respect to the direction of gravity. In addition, the periphery of the electrical connecting portion 22 as viewed in the direction of the arrow C in FIG. 3 is shown in part (c) of FIG. 4. The direction of the arrow C is an oblique direction from the upper side to the lower side with respect to the direction of gravity. In the direction of the arrow B and the direction of the arrow C, the electrical connecting portion 22 is not seen, and the connector 22*a* extending toward the inside of the recording apparatus from the electrical connecting portion 22 is seen. The connector 22*a* extends from the electrical connecting portion 22 and has the function of wiring that enables the electrical connecting portion 22 to be electrically connected to the inside of the recording device. As a material for forming the connector 22*a*, copper alloy (gold plating) and the like are available.

A cross-section taken along line A-A' of part (b) of FIG. 4 is shown in part (d) of FIG. 4. As described above, the ink receiving tube 21 projects from the rear side surface of the hole 14*f* formed by the hole forming member 14*b*. In addition, the plurality of electrical connecting portions 22 are interposed between the walls 23*a*, 23*b*.

Next, FIG. 4 (*e*) shows the periphery of the electrical connecting portion 22 of the mounting portion as viewed in the direction of the arrow D in FIG. 3. The direction of the arrow D in FIG. 3 is the direction from the front side to the back side when mounting the ink cartridge to the mounting portion. In addition, it is also the extending direction of the hole (hole 14*d* and hole 14*f*) formed by the hole forming member 14*a* and the hole forming member 14*b*. Furthermore, it is the y direction, the horizontal direction perpendicular to the direction of gravity. As viewed in the direction of arrow D, the ink receiving tube 21 is visible on the rear side of the hole 14*f* formed by the hole forming member 14*b*. In addition, the wall 23*a*, and the wall 23*b* as another wall arranged so as to partially overlap the wall 23*a* on the far side of the wall 23*a* are seen. Here, the hole forming member 14*a* is omitted, but when the hole forming member 14*a* is provided, the hole forming member 14*a* is seen in front of the hole forming member 14*b*. And, the ink receiving tube 21 is seen on the rear side of the hole formed by connecting the holes (the hole 14*d* and the hole 14*f*) formed by the hole forming member 14*a* and the hole forming member 14*b*. To the ink receiving tube 21, the ink cartridge is inserted from the front side to the rear side (y direction) along the inserting direction.

Figure 5:
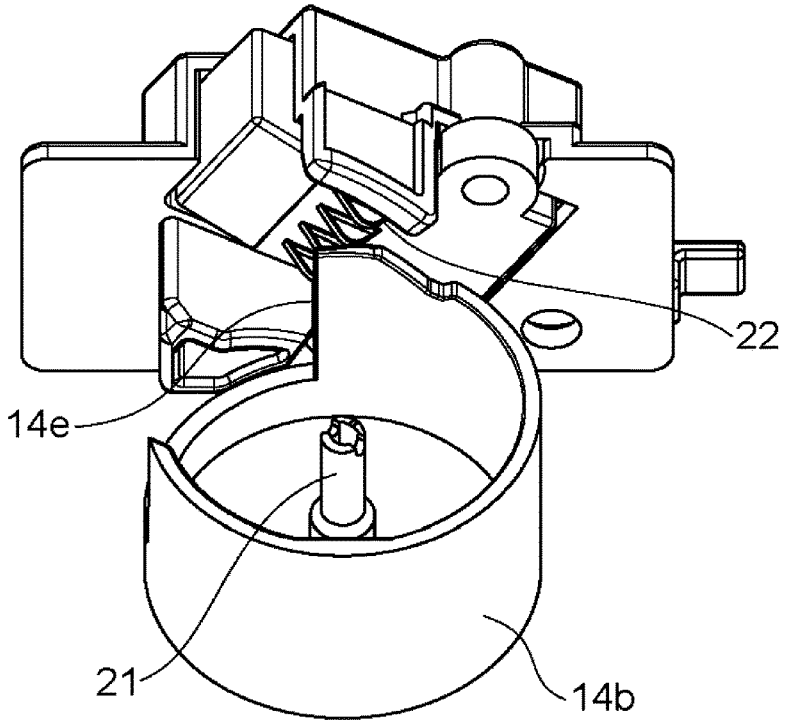
FIG. 5 is an illustration showing a structure around the electrical connecting portion of the mounting portion.
Figure 5:
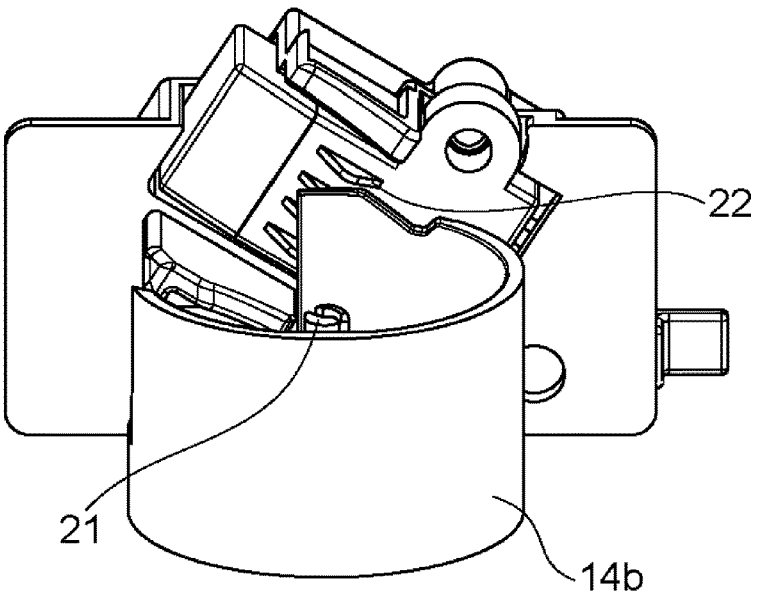

Parts (a) and (b) of FIG. 5 is a view of the periphery of the electric connecting portion 22 as viewed another angular direction. Part (a) of FIG. 5 shows the periphery of the electrical connecting portion 22 as viewed in the direction of the arrow E in FIG. 3. Part (b) of FIG. 5 shows the periphery of the electrical connecting portion 22 as viewed in the direction of the arrow F in FIG. 3. The arrow E direction and the arrow F direction obliquely extend from the lower side to the upper side in the gravy direction around the electric connecting portion 22. As described in part (a) of FIG. 4, a part of the electrical connecting portion 22 of the electrical connecting portion 22 is covered with the hole forming member 14*b* in the downward direction of the electrical connecting portion 22. In addition, in Parts (a) and (b) of FIG. 5, the four electrical connecting portions 22 are all in the form of connector pins. Each connector pin has a triangular shape. The connector pin is deformed so that the apex of the triangle contacts the pad electrode of the ink cartridge to be collapsed, by which an electrical contact point is provided. The electrical contact point can be thought of as the center of gravity position of the connector pin that is in contact with the pad electrode when the mounting is completed. In this electrical contact point, the pad electrode and the connector pin (electrical connecting portion) can be electrically connected. The pad electrode and the electrical connecting portion are electrically connected and electricity flows through the electrical contact point, so that the recording apparatus can detect the mounting of the ink cartridge, for example. Besides, for example, the recording apparatus reads the information (ink property information such as ink color information and/or ink remainder information) the ink cartridge provided in a chip or the like, and the recording apparatus can recognize the type of the mounted ink cartridge.

<Ink Cartridge>

Figure 6:
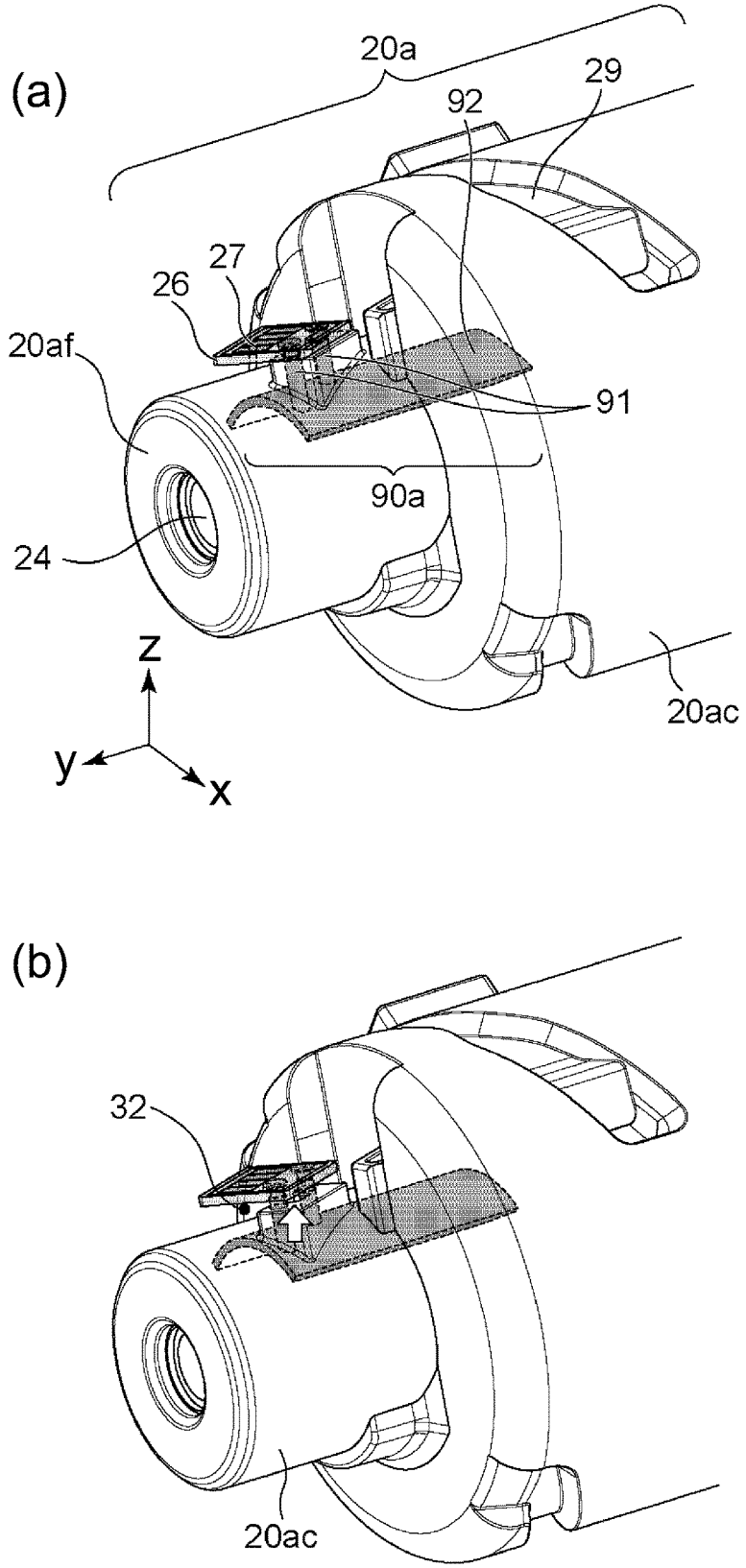
FIG. 6 is an illustration showing how pad electrodes move.
Figure 7:
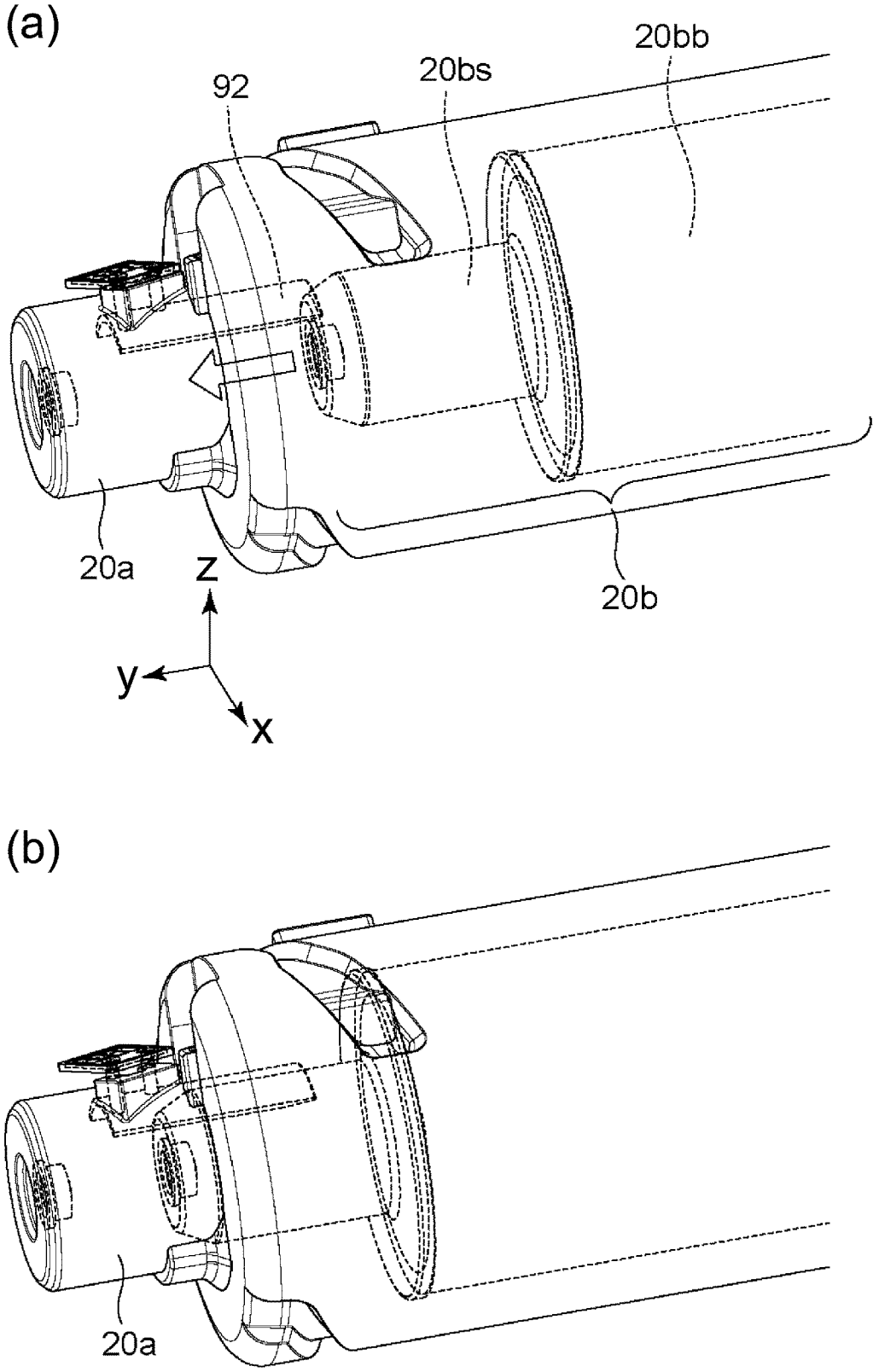
FIG. 7 is an illustration showing how the ink cartridge is mounted.
Figure 8:
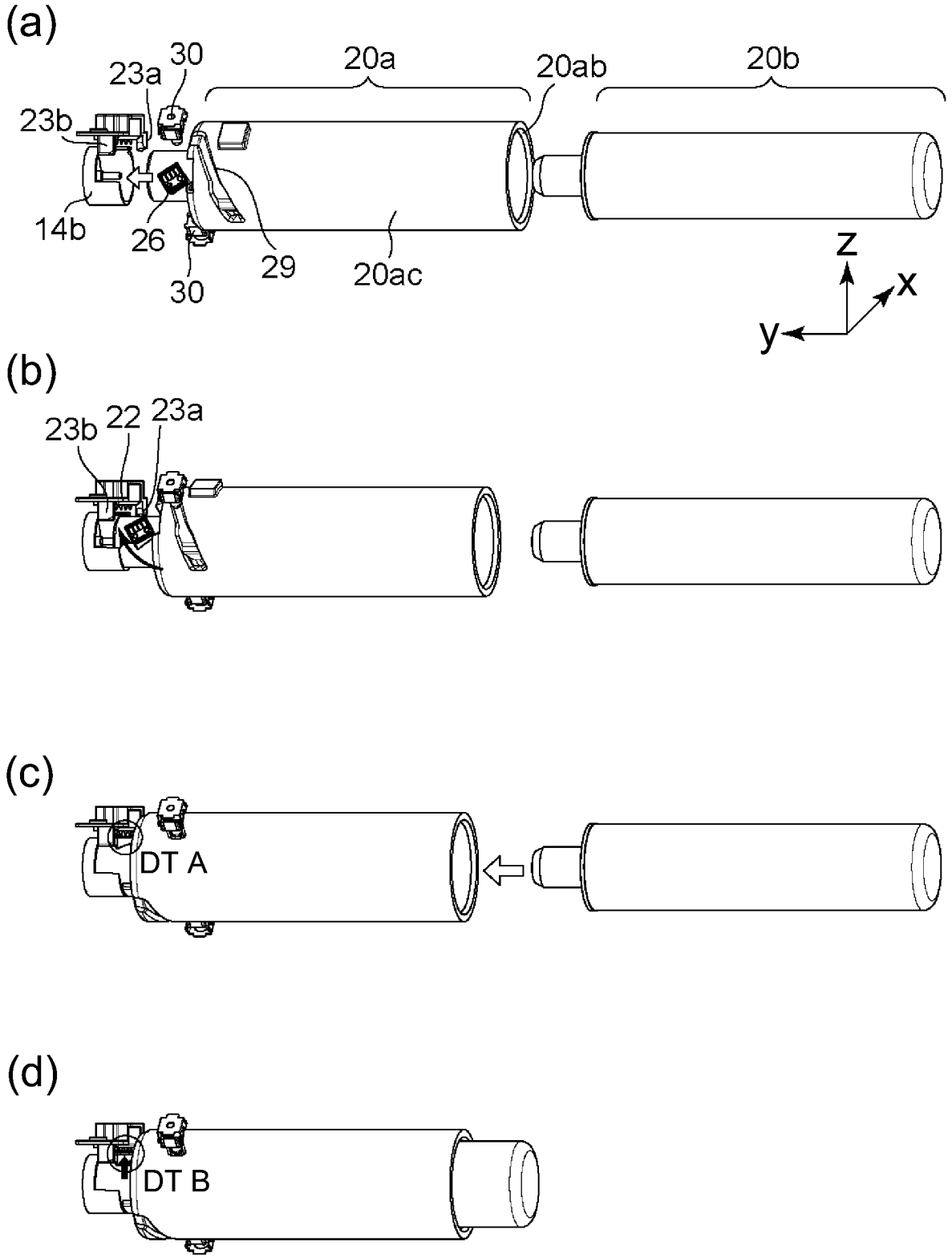
FIG. 8 is an illustration showing how the ink cartridge is mounted.

FIGS. 6 to 8 show the ink cartridge according to Embodiment 1. As shown in FIG. 8, the ink cartridge of Embodiment 1 comprising two members. In FIG. 8, the left portion of part (a) is a first portion (ink cartridge adapter) 20*a*, and a right portion is the second portion (ink container) 20*b*. The cartridge adapter 20*a* does not contain ink and can be regarded as a member that does not contain ink. The cartridge adapter 20*a* does not contain ink and can be regarded as a member which does not contain ink. On the other hand, the ink container 20*b* contains ink. Here, a combination of the cartridge adapter 20*a* and the ink container 20*b* is an ink cartridge.

FIG. 6 is an enlarged view of a neighborhood of a first portion 20*af* of the cartridge adapter 20*a*. The ink cartridge 20 (casing) has at least a first portion 20*af*, a second portion 20*ab*, and a third portion 20*ac* as portions facing to outside of the ink cartridge 20. The first portion 20*af* has an insertion portion 24 into which the ink receiving tube 21 shown in FIG. 3 is inserted. Therefore, it can be said first portion 20*af* is a front portion of the cartridge adapter 20*a*. Here, the portion opposite to the first portion 20*af* is the second portion 20*ab* (shown in part (a) of FIG. 8). And, the first portion 20*af* and the second portion 20*ab* are connected by the third portion 20*ac*. The first portion 20*af* and the second portion 20*b* are end portions of the ink cartridge 20, and therefore, it can be said first portion 20*af* is referred to as a first end portion, and the second portion 20*ab* is referred to as a second end portion. The third portion 20*ac* is between the first portion 20*af* and the second portion 20*ab*, and in FIG. 6, the third portion 20*ac* is extended in a direction perpendicular to the first portion 20*af* and the second portion 20*ab*. The first portion 20*af*, the second portion 20*ab*, and the third portion 20*ac* may each be a surface.

Here, the outward facing portion of the ink cartridge is the portion facing away from the central axis of the ink cartridge (the axis extending through the center of gravity of the ink cartridge and extending parallel to the longitudinal direction of the ink cartridge). For example, since the side surface of the casing of the cylindrical ink cartridge shown in FIG. 8 faces away from the central axis of the ink cartridge, it is the outward facing portion of the ink cartridge. On the other hand, for example, the surface of the electrode unit 90*a* shown in part (a) of FIG. 6 opposite to the side where the electrode portion 26 is provided is exposed to the outside of the ink cartridge (the gap 32 below the electrode portion 26). It is. On the other hand, for example, the surface of the electrode unit 90*a* shown in part (a) of FIG. 6 opposite to the side where the electrode portion 26 is provided is exposed to the outside of the ink cartridge (the gap 32 below the electrode portion 26). However, since it faces in the direction toward the central axis of the ink cartridge, it is not the portion facing the outside of the ink cartridge but the portion facing the inside of the ink cartridge.

Part (a) of FIG. 6 is an illustration showing a state before the ink cartridge is mounted to the mounting portion. The ink cartridge is provided with an electrode unit 90*a* mounted to the casing. The electrode unit 90*a* may be separate from the casing, but here, an integrated example is shown. The electrode unit 90*a* has a column 91 and a push-up plate 92, and the electrode portion 26 is on the column 91. The chip-shaped electrode portion 26 has a memory element which stores ink color information and remaining ink amount information. The electrode portion 26 is provided with a plurality of pad electrode 27 contactable with the Aelectrical connecting portion 22 of the recording apparatus (mounting portion) to be electrically connected to the electrical connecting portion 22. That is, a plurality of such pad electrode 27 are mounted to the casing. More specifically, it is mounted to the third portion 20*ac* of the casing. Here, the pad electrode 27 and the electrode portion 26 including a chip may be provided at positions separated from each other, in which case, they are be electrically connected by wiring or the like. The column 91 of the electrode unit 90*a* is extended through the hole of the ink cartridge adapter 20*a*, and the side opposite to the electrode unit 90*a* is heat-clamped in the hole. As shown in part (b) of FIG. 6, the push-up plate 92 is pushed upward (in the +z direction) to move in a direction away from the side surface of the casing (here, the surface indicated as the third portion 20*ac*), thereby projecting from the side surface of the casing. As a result, the electrode portion 26 and the pad electrode 27 are also pushed upward (in the +z direction) to move in the direction away from the side surface of the casing, thereby projecting from the side surface of the casing. In this state, the pad electrode 27 is brought into contact with the electrical connecting portion 22 to be electrically connected thereto. After the electrode portion 26 and the pad electrode 27 have moved, a gap 32 having a size corresponding to the amount of movement is formed below the electrode portion 26 and the pad electrode 27 (in the −z direction).

The mechanism by which the plurality of pad electrode 27 move away from the side surface of the casing and project from the side surface of the casing will be described in more detail. Part (a) of FIG. 7 shows a state before electrical connection is established between the pad electrodes and the electrical connection portion. At this point of time, only the cartridge adapter 20*a* is mounted to the mounting portion (not shown in FIG. 7) on the main assembly side. In addition, the plurality of pad electrodes are not moved and do not project from the side surface of the casing. The ink container 20*b* for storing ink is mounted to the cartridge adapter 20*a* in this state.

Part (b) of FIG. 7 shows a state in which the ink container 20*b* is mounted. The ink container 20*b* is mounted to the mounting portion by being inserted into the cartridge adapter 20*a*. The ink container 20*b* has a large diameter portion 20*bb* and a small diameter portion 20*bs*, and as shown in FIG. 7, it is inserted along the +y direction with the small-diameter portion 20*bs* at the leading side. The distance from the ink receiving tube to the side surface of the small-diameter portion 20*bs* of the ink container 20*b* is longer, in the z direction (gravity direction), than the distance from the ink receiving tube to the push-up plate 92 in the mounting portion. For this reason, in the process of inserting the ink container 20*b*, the small diameter portion 20*bs* of the ink container 20*b* contacts the push-up plate 92, so that the ink container 20*b* is inserted while pushing up the push-up plate 92. By this push-up operation, the pad electrode 27 of the electrode unit 90*a* moves away from the side surface of the casing and projects from the side surface of the casing. And, it contacts the electrical connecting portion 22 of the mounting portion.

Here, although the example in which the plurality of pad electrode 27 move when the small-diameter portion 20*bs* of the ink container 20*b* contacts the push-up plate 92 is shown in this embodiment, the movement of the plurality of pad electrode 27 by the push-up plate 92 may be accomplished by other methods. For example, the ink container 20*b* may have a uniform diameter, and a portion of the ink container 20*b* may be pushed up by contacting the push-up plate 92. In addition, the push-up plate 92 may be pushed up by another member not using the ink container 20*b*.

Referring to FIG. 8, the overall structure for mounting the ink cartridge including the cartridge adapter 20*a* will be described. First, as shown in part (a) of FIG. 8 and part (b) of FIG. 8, the cartridge adapter 20*a* including the electrode portion 26 is mounted while rotating the screw relative to the mounting portion. The cartridge adapter 20*a* is provided with a groove-shaped guide portion 29. In addition, two lock pins 30 are provided on the mounting portion side. The lock pin 30 can be expanded and contracted by a spring, and the two lock pins 30 sandwich the cartridge adapter 20*a* and press the cartridge adapter 20*a*. While the lock pin 30 and the guide portion 29 are engaged with each other, the cartridge adapter 20*a* is rotated. By this, the cartridge adapter 20*a* is rotated while being advanced in the inserting direction. At this time, the lock pin 30 is regulated by the guide portion 29, and therefore, the direction of screw rotation is determined by the guide portion 29, so that the rotation is stabilized. As the screw rotation proceeds, the electrode portion 26 advances between the positioning walls 23*a* and 23*b*. And, when the electrode portion 26 is placed below the electrical connecting portion 22, the mounting of the cartridge adapter 20*a* is completed (part (c) of FIG. 8). Here, in Embodiment 1, the hole forming member 14*b* does not cover the electrical connecting portion 22 as viewed in the direction shown in part (a) of Figure.

Next, as shown in part (c) of FIG. 8 and part (d) of FIG. 8, the ink container 20*b* is mounted inside the cartridge adapter 20*a*. This mounting is the same as that described in FIG. 7. By this mounting, as described so far, the pad electrode 27 of the electrode unit 90*a* moves away from the side surface of the casing, and can be electrically connected to the electrical connection unit 22.

Figure 9:
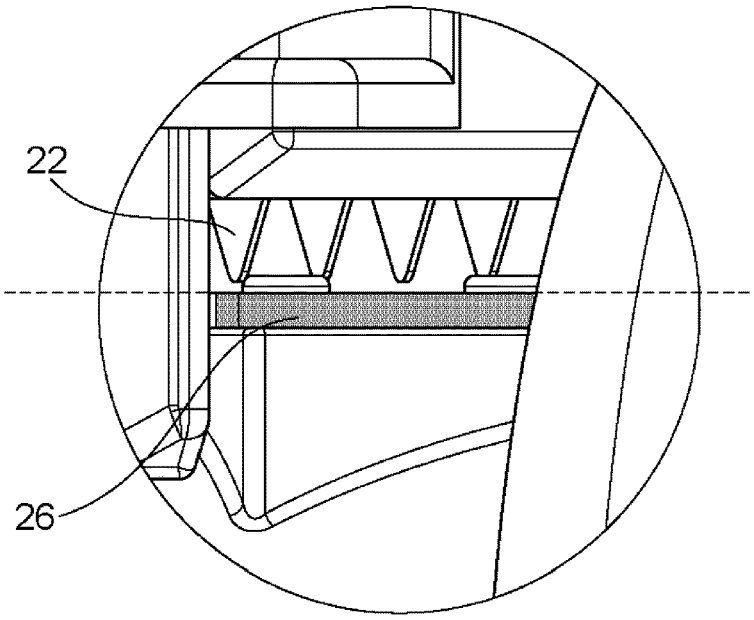
FIG. 9 is an illustration showing how the pad electrodes move.
Figure 9:
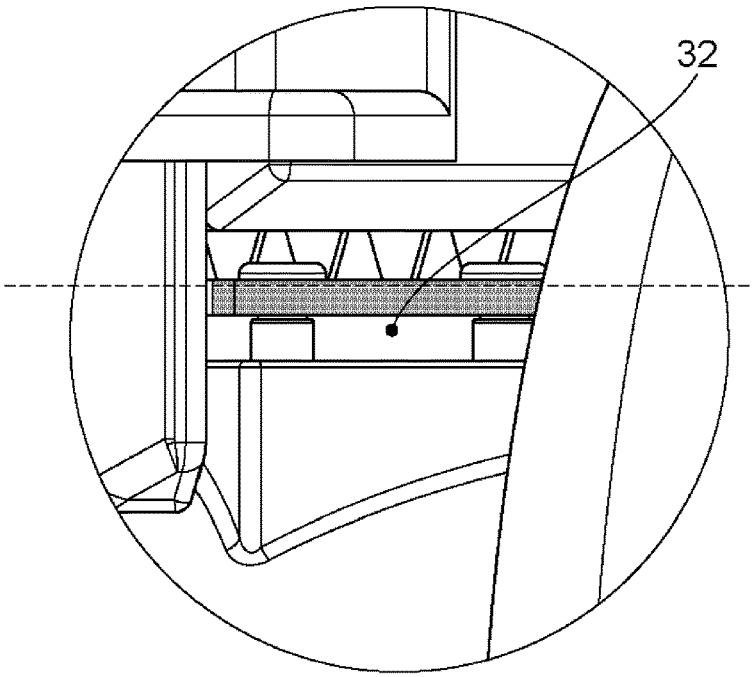

Part (a) of FIG. 9 and part (b) of FIG. 9 show the state in which between the part (c) of FIG. 8 and the part (d) of FIG. 8, the electrode portion 26 including the pad electrodes is pushed up and raised, so that it can be electrically connected to the electrical connecting portion 22. As shown in part (b) of FIG. 9, when the pad electrodes of the electrode portion 26 become in a state that they can be electrically connected to the electrical connecting portion 22, a gap 32 is formed below the electrode portion 26 and the pad electrodes.

As described above, in the case that the plurality of pad electrode 27 move away from the side surface of the casing and project from the side surface of the casing, it becomes less likely for the pad electrode 27 to be brought into contact against the electrical connection portion with an impact force in the inserting direction of the ink cartridge 20. Therefore, the impact received by the pad electrode 27 and the electrical connecting portion 22 can be reduced.

In contrast, the impact can be reduced by moving the pad electrodes inside the casing (inside the side surface). For example, the pad electrodes are mounted to the inside of the casing and is moved so as to come out to the side of the casing. However, as described in this embodiment, it is less likely to receive an impact by placing the pad electrodes away from the side surface of the casing to such an extent of projecting from the side surface of the casing.

Here, part (a) of FIG. 8 shows an example in which four pad electrodes are provided as a plurality of pad electrodes. This is an example of four pad electrodes which are provided on the ink cartridge is provided with (two for the power supply line and two for the information line for accessing information stored in the memory element of the electrode portions 26). As described above, it is further preferable that the ink cartridge has four pad electrodes. In more detail, one of them is a reference terminal on the circuit, and is a pad electrode for electrical grounding that is basically always at zero potential. In addition, there is a pad electrode for the clock signal which produces pulses at a fixed frequency and is the reference for the minimum unit of data transmission. In addition, there are power supply pad electrodes which have a positive potential with the power supply for operating IC, and so on, and a data signal pad electrode which operates the circuit by sending 0/1 signals in accordance with the data. It is preferable that the pad electrode for ground is larger than other pad electrodes. This is because it is difficult to stabilize the operation without first connecting the ground pad electrode and then keeping the reference potential constant, and therefore, this is to make the connection stable.

Any method may be used to remove the ink cartridge from the mounting portion, but it is preferable that the operation is reverse of the above mounting operation. At this time, it is preferable that the pad electrode moves in a direction toward the side surface of the casing and returns to a position where it does not project from the side surface of the casing. If it is difficult to move the pad electrodes just by pulling out the ink cartridge, the pad electrodes may be moved by another member.

Embodiment 2

Also in Embodiment 2, the plurality of pad electrodes move in a direction away from the side surface of the casing of the ink cartridge and project from the side surface of the casing, so that the plurality of pad electrodes may be electrically connected to the electrical connecting portion. In the following, the description is focused on the differences from Embodiment 1.

Figure 10:
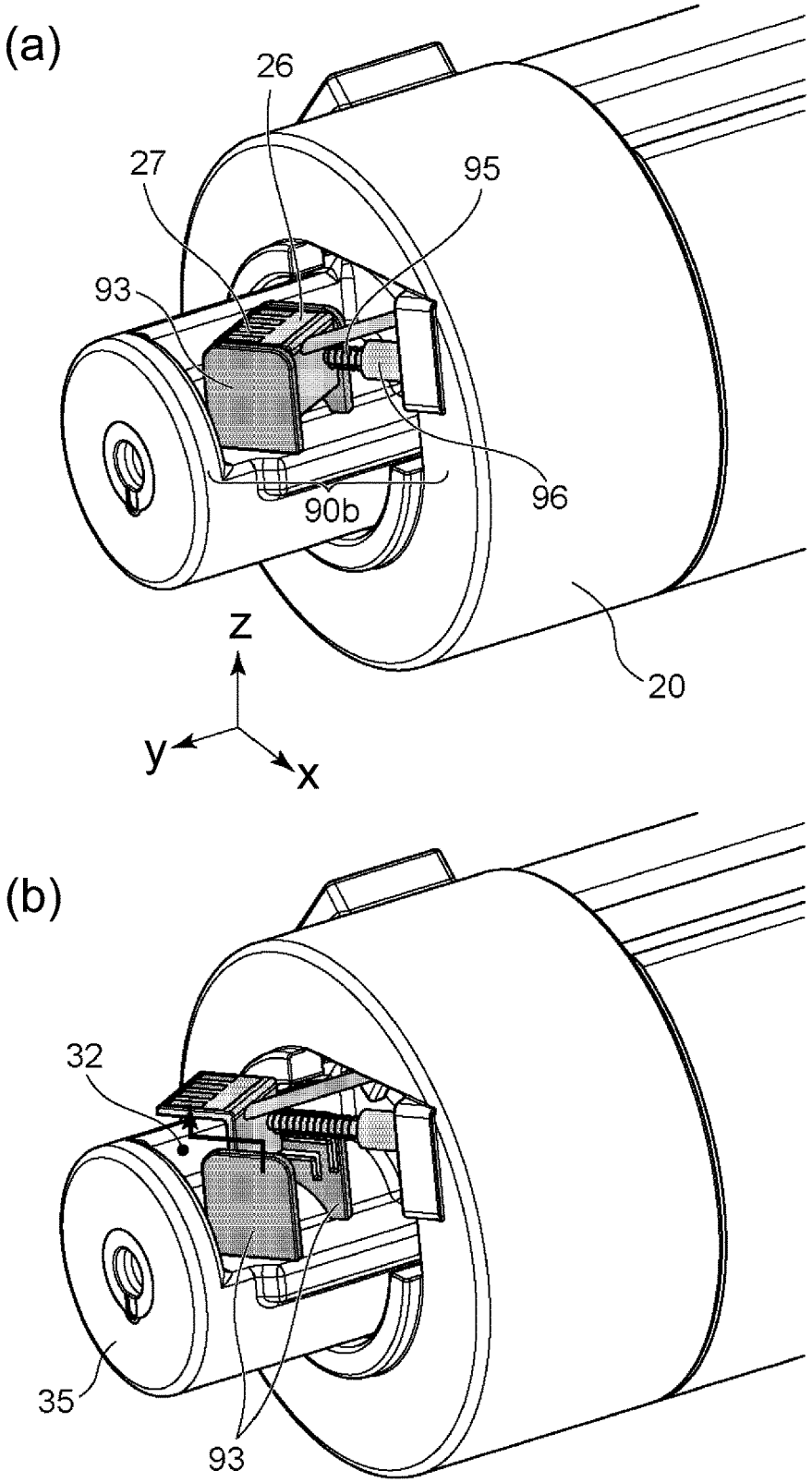
FIG. 10 is an illustration showing how the pad electrodes move.
Figure 13:
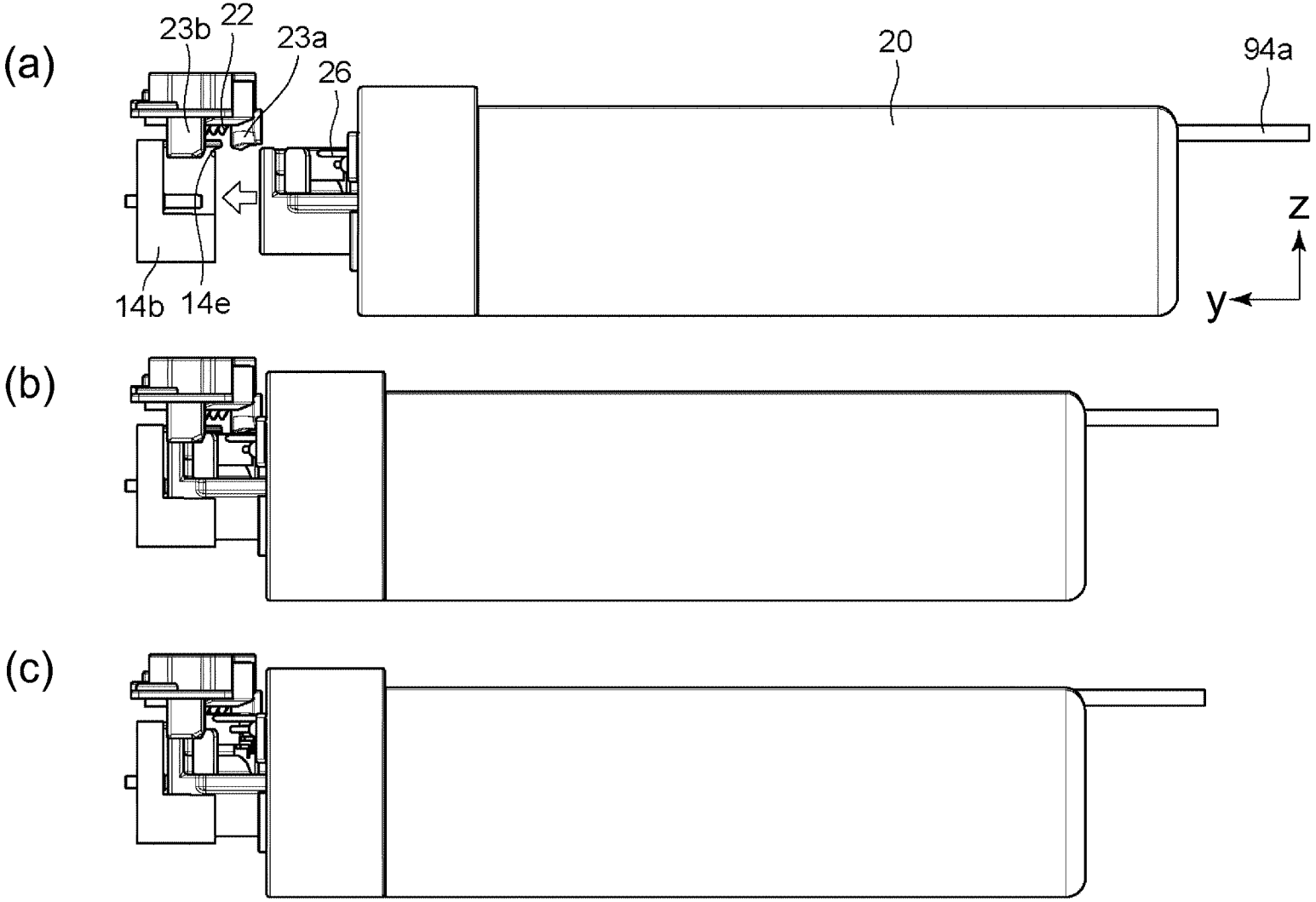
FIG. 13 is an illustration of how the ink cartridge is mounted.

As shown in FIG. 13, the ink cartridge 20 of Embodiment 2 is not divided into two parts. FIG. 10 is an enlarged view of a front portion (first portion) of the ink cartridge 20. Part (a) of FIG. 10 is an illustration showing a state before the ink cartridge is mounted to the mounting portion. The ink cartridge is provided with an electrode portion unit 90*b* mounted on the casing. As in Embodiment 1, the electrode portion unit 90*b* includes a chip-shaped electrode portion 26 having a plurality of pad electrode 27. However, it does not have a column or a push-up plate, and instead it has an electrode portion guide portion 93, an operation pin 94*a*, an urging spring 95, and a spring accommodating portion 96. The electrode portion guide portion 93 is fixed on the casing of the ink cartridge 20.

Part (b) of FIG. 10 is an illustration showing a state in which the electrode portion 26 and the pad electrode 27 move away from the side surface of the casing and project from the side surface of the casing, so that the plurality of the pad electrode 27 thus moved can be electrically connected to the electrical connecting portion. As in Embodiment 1, a gap 32 is formed below the electrode portion 26 and the pad electrode 27 as the electrode portion 26 and the pad electrode 27 are moved.

Figure 11:
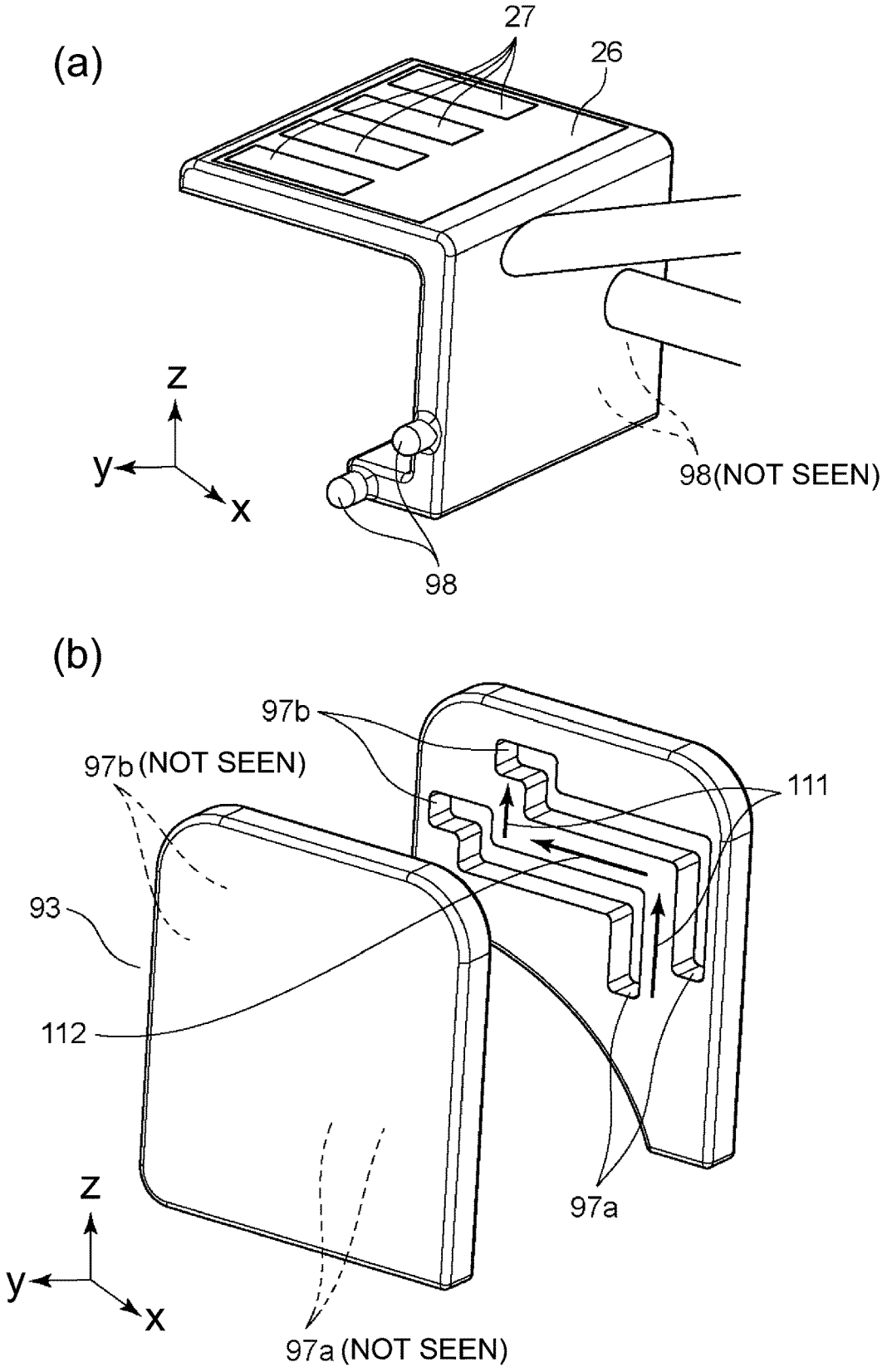
FIG. 11 is an illustration showing a structure of an electrode unit.
Figure 12:
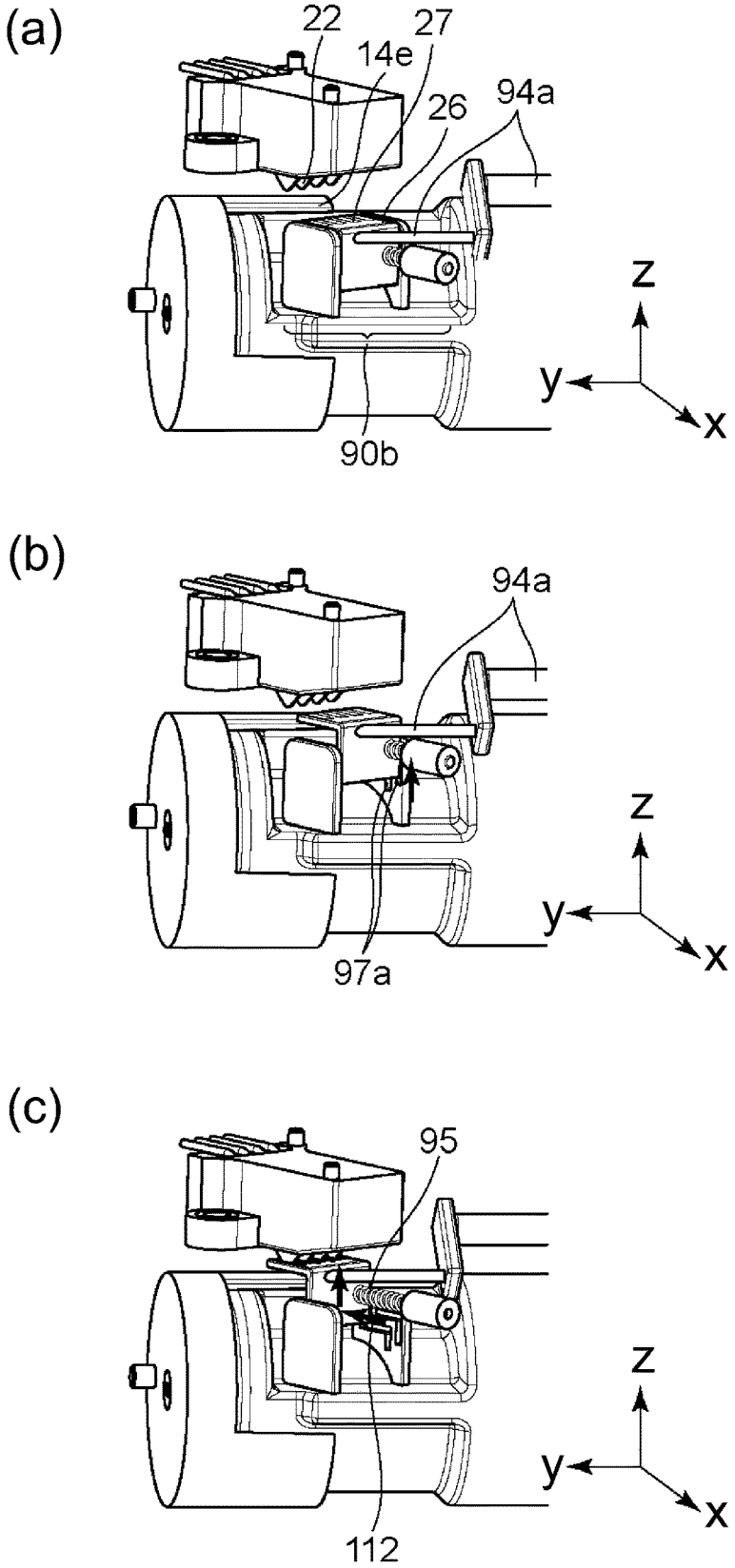
FIG. 12 is an illustration showing how the pad electrodes move.

The mechanism in which the plurality of pad electrode 27 move away from the side surface of the casing and project from the side surface of the casing will be described in more detail. Part (a) in FIG. 11 and part (b) in FIG. 11 are illustrations showing the electrode unit divided into two portions, for explanation. As shown in part (b) of FIG. 11, the electrode portion guide portion 93 is provided with guide grooves (97*a*, 97*b*). The guide pin 98 shown in part (a) of FIG. 11 moves along the guide groove, so that the electrode portion 26 and the plurality of pad electrode 27 of the electrode portion unit 90*b* move. Before the plurality of pad electrode 27 move, the guide pin 98 is disposed at a start point 97*a* of the guide groove. Thereafter, the pad electrode 27 can be electrically connected to the electrical connecting portion 22 by repeating straight movement in the moving direction 111 and the moving direction 112 until it moves to the end point 97*b* of the guide groove. This movement is performed by moving the electrode portion 26 and the pad electrode 27 using the operation pin 94*a* and the spring 95. As will be understood from FIGS. 12 and 13, the operation pin 94*a* penetrates the ink cartridge 20 in the inserting direction (the direction from the second portion toward the first portion, in this case, the longitudinal direction), and adjust the positions of the plurality of pad electrode 27. FIG. 12 shows the process of movement of the electrode portion 26 (pad electrode 27). With respect to the moving direction 111 shown in FIG. 11, it is moved using the operation pin 94*a*. With respect to the moving direction 112, the urging spring 95 is provided, and therefore, when the operation pin 94*a* is moved upward, the plurality of pad electrode 27 are urged by the urging spring, and the movement is effected.

Referring to FIG. 13, the overall structure for mounting the ink cartridge 20 will be described. Part (a) of FIG. 13 is an illustration of the state before the pad electrodes move. At the time of the state shown in part (a) in FIG. 13, as described above, the guide pin is placed in the guide groove, and the electrode portion 26 is accommodated in the electrode portion guide portion. In this state, the ink cartridge 20 is inserted into the mounting portion of the main assembly along the y direction. The positioning walls 23*a* and 23*b* and a support member 14*e* for the hole forming member 14*b* are provided in the mounting portion. Here, the electrode portion 26 of the ink cartridge is disposed below the positioning walls 23*a* and 23*b* and the support member 14*e*, and therefore, the ink cartridge can be mounted without contacting them.

As shown in part (b) of FIG. 13, the electrode portion 26 is placed below the electrical connecting portion 22 by the mounting. In this state, even in this state, the electrical connection is not yet established.

Next, as shown in part (c) of FIG. 13, the electrode portion 26 advances while moving straight in a different direction with respect to the inserting direction, whereby the electrical connecting portion 22 and the pad electrodes are connected with each other. In addition, the support member 14*e* is inserted into the gap 32 provided by the movement of the electrode portion 26. By inserting the support member 14*e* into the gap 32, the electrical connection can be further stabilized.

Also in Embodiment 2, the plurality of pad electrode 27 move away from the side surface of the casing and project from the side surface of the casing, and it becomes less likely for the pad electrode 27 to be brought into contact against the electrical connecting portion with an impact force in the inserting direction of the ink cartridge 20. Therefore, the impact received by the pad electrode 27 and the electrical connecting portion 22 can be reduced.

Embodiment 3

Also in Embodiment 3, the plurality of pad electrodes move in a direction away from the side surface of the casing of the ink cartridge and project from the side surface of the casing, so that the plurality of pad electrodes can be electrically connected to the electrical connecting portion. In the following, the description will be made on the points different from Embodiments 1 and 2.

Figure 14:
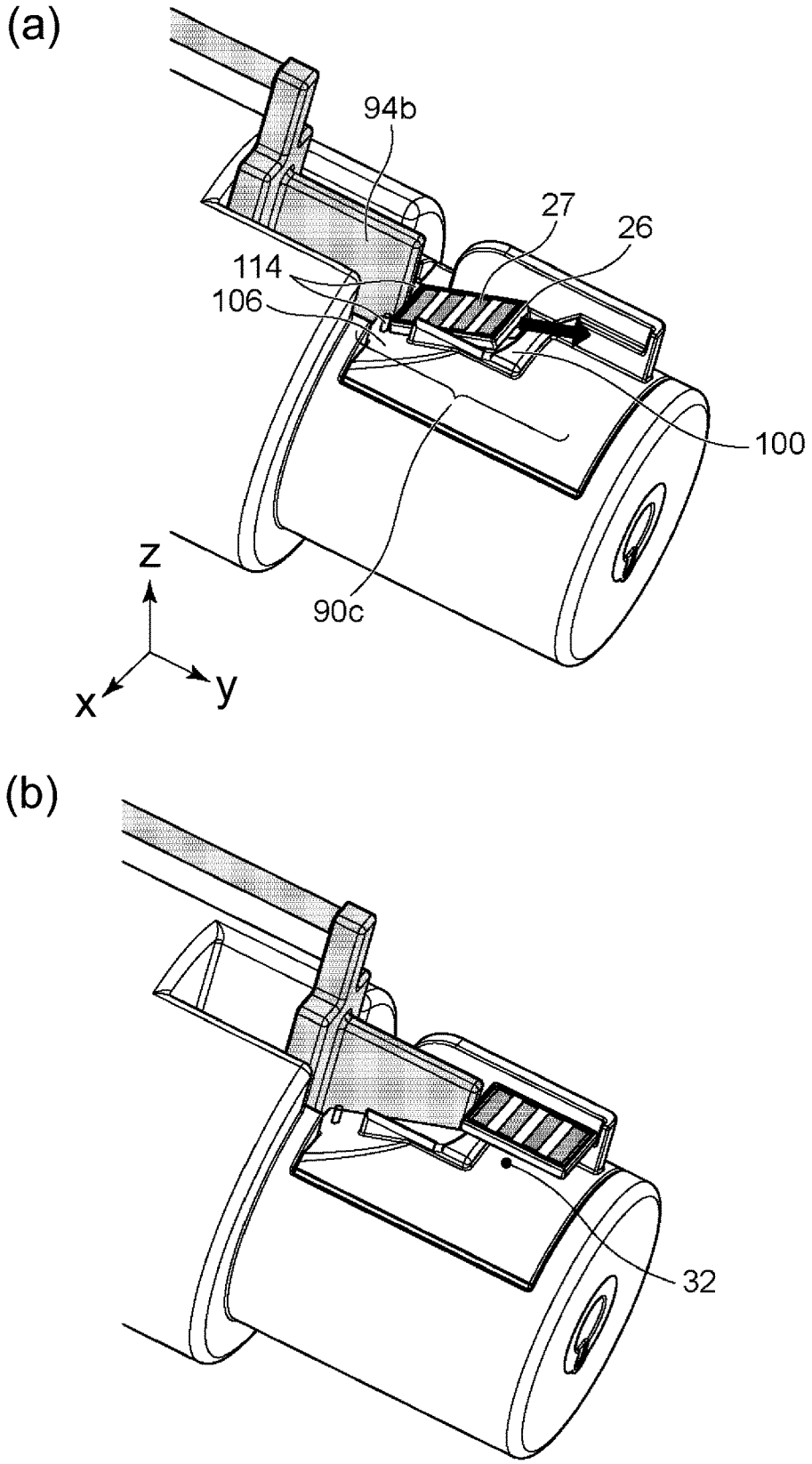
FIG. 14 is an illustration showing how the pad electrodes move.
Figure 16:
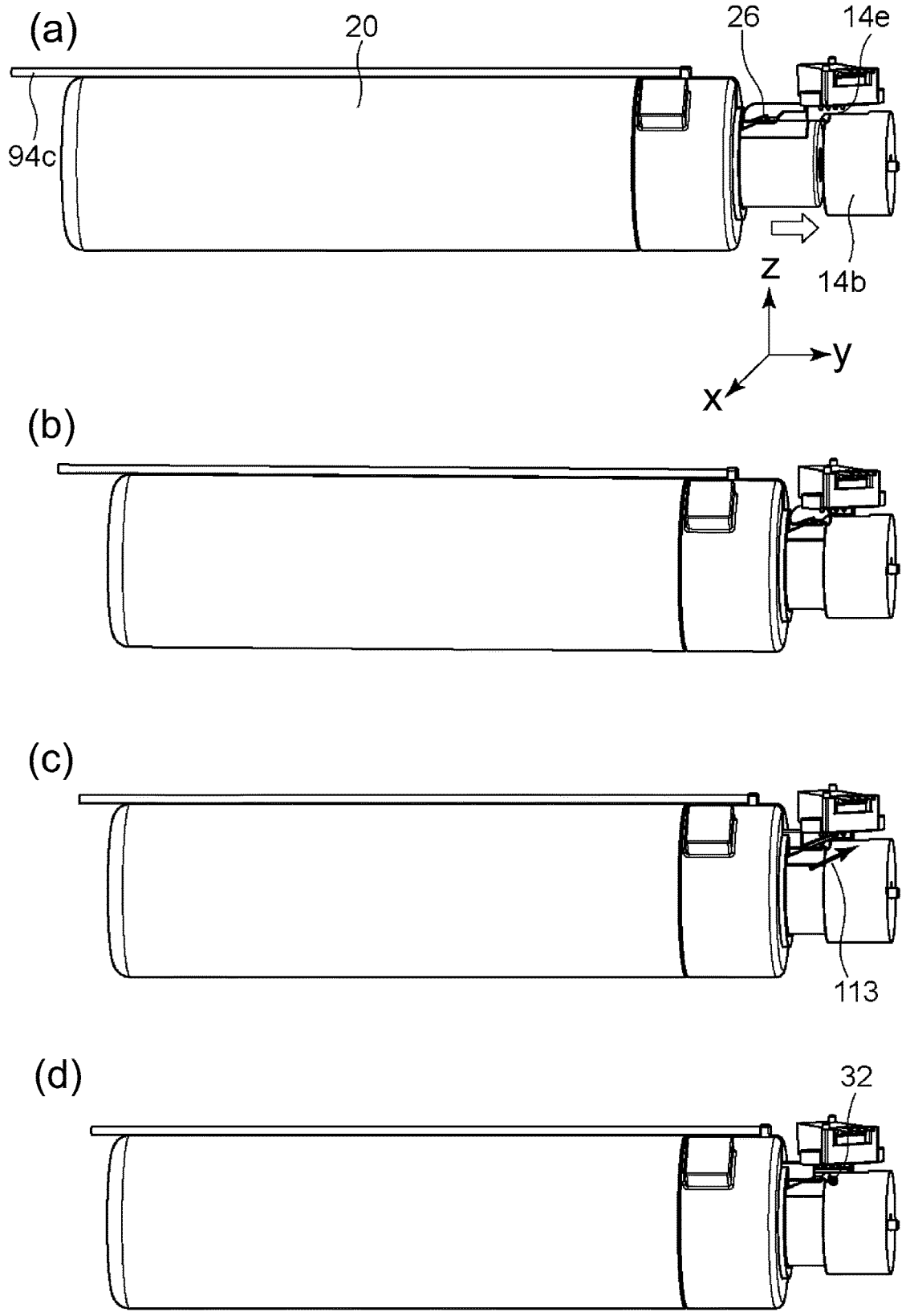
FIG. 16 is an illustration of how the ink cartridge is mounted.

As shown in FIG. 16 the ink cartridge 20 of Embodiment 3 is not divided into two parts. The ink cartridge 20 includes a large diameter portion and a small diameter portion. FIG. 14 is an enlarged view of the neighborhood of the front portion (first portion) of the ink cartridge 20. Part (a) of FIG. 14 is an illustration showing a state before the ink cartridge is mounted on the mounting portion. An electrode unit 90*c* is mounted on the small diameter portion of the ink cartridge casing. The electrode unit 90*c* includes a chip-shaped electrode portion 26 including a plurality of pad electrode 27. The electrode unit 90*c* includes an electrode unit mounting base 100, the electrode portion 26, and an operation pin 94*c*. The electrode unit mounting base 100 is provided with an inclined surface 106, and the electrode portion 26 is movably provided on the inclined surface 106. In addition, a fixing pin 114 is provided on the inclined surface 106, and the fixing pin 114 fixes the electrode portion 26. The inclined surface 106 is a surface which is inclined with respect to the longitudinal direction of the electrode unit mounting base 100 and the ink cartridge. The operation pin 94*c* is for adjusting the position of the pad electrode.

Part (b) of FIG. 14 shows a state in which the electrode portion 26 and the pad electrode 27 have moved away from the side surface of the casing and have projected from the side surface of the casing, and the plurality of the moved pad electrode 27 can be electrically connected to the electrical connecting portion. A gap 32 is formed below the electrode portion 26 and the pad electrode 27, corresponding to the amount of movement of the electrode portion 26 and the pad electrode 27.

Figure 15:
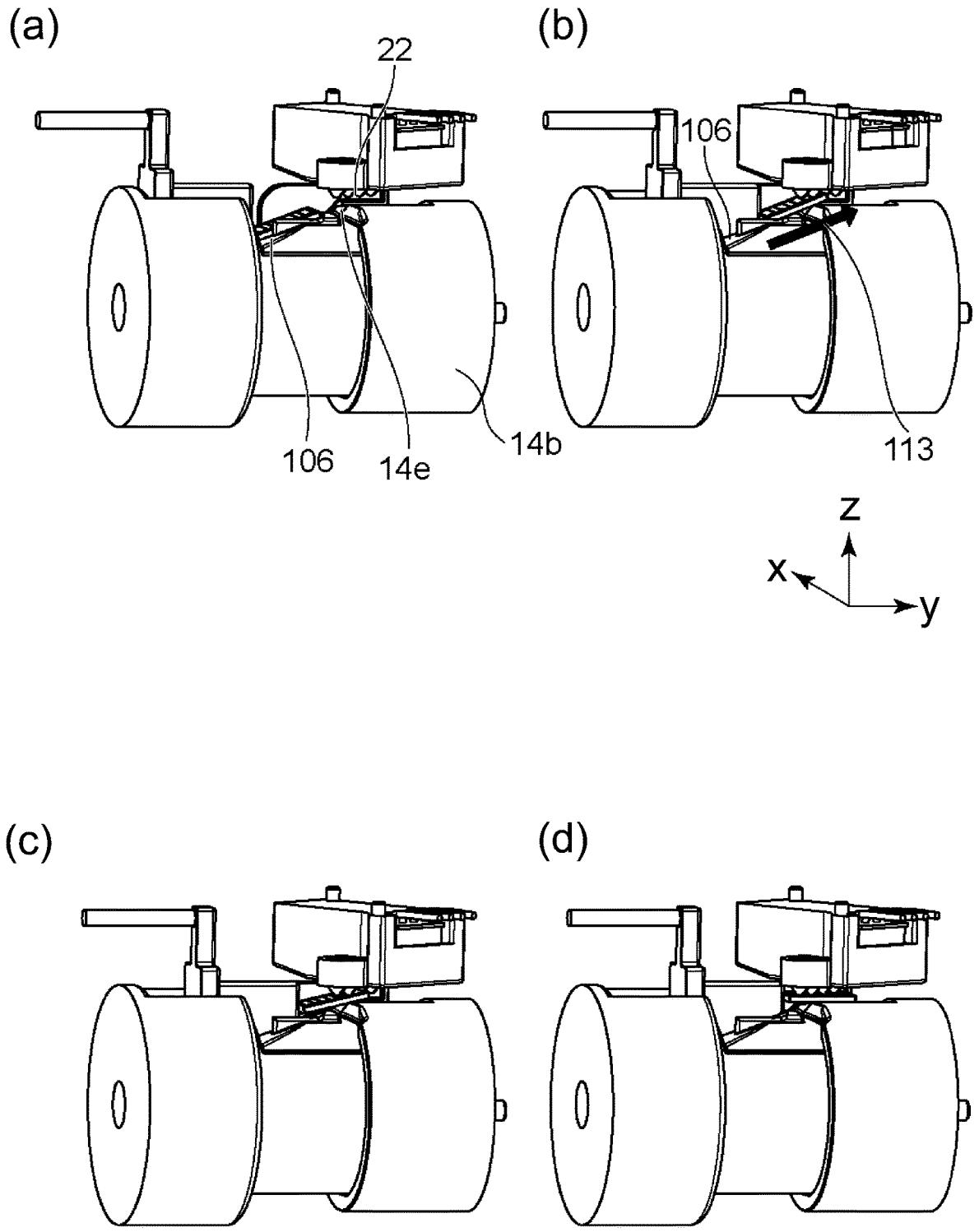
FIG. 15 is an illustration showing how the pad electrodes move.

The mechanism in which the plurality of pad electrode 27 move away from the side surface of the casing and project from the side surface of the casing will be described in more detail. Part (a) in FIG. 15 shows a state before the pad electrode 27 move. In this state, the pad electrode 27 and the electrode portion 26 are placed on the inclined surface 106 of the electrode unit mounting base 100. Then, by pressing the electrode portion 26 by the operation pin 94*c*, as shown in part (b) of FIG. 15, the pad electrode 27 and the electrode portion 26 move. The pad electrode 27 and the electrode portion 26 proceed in the moving direction 113 along the inclined surface 106. In this embodiment, a support member 14*e* for the hole forming member 14*b* is provided. The pad electrode 27 and the electrode portion 26 move from the inclined surface 106 to the support member 14*e*. After moving to the support member 14*e*, the electrode portion 26 is fixed by being sandwiched between the support member 14*e* and the electrical connecting portion 22, so that the electrical connecting portion 22 and the pad electrode 27 can be electrically connected. The pad electrode 27 and the electrode portion 26 are moved by the operation pin 94*c*, but they may be moved by other methods. Here, the moving direction of the pad electrode 27 and the electrode portion 26 is a direction including components in the z direction and the y direction (a direction inclined from the y direction toward the z direction).

Referring to FIG. 16, the overall structure for mounting the ink cartridge 20 will be described. Part (a) of FIG. 16 is a view shown in a state before the pad electrodes move, and the electrode portion 26 is place on the inclined surface 106 of the electrode unit mounting base 100. From this state, the ink cartridge 20 is inserted into the mounting portion to obtain the state shown in part (b) of FIG. 16. Next, as shown in part (c) of FIG. 16, the pad electrode 27 and the electrode portion 26 are moved by manipulating the operation pin 94*c*, as shown in part (d) of FIG. 16, so that the pad electrode 27 are brought into a state capable of being electrically connected to the electrical connecting portion 22. Here, a support member 14*e* is provided on the mounting portion side, but the electrode portion 26 is disposed below the support member 14*e*, and therefore, it can be mounted without contacting the support member 14*e*. The above-described positioning walls 23*a* and 23*b* (not shown) may be provided on the mounting portion, and also in such a case, the mounting can be carried out without contacting the support member 14*e*.

In this embodiment, the support member 14*e* is inserted into the gap 32 provided after the electrode portion 26 moves on the inclined surface 106. By inserting the support member 14*e* into the gap 32, the electrical connection can be further stabilized.

Also in Embodiment 3, the plurality of pad electrode 27 move away from the side surface of the casing and project from the side surface of the casing, and it becomes less likely for the pad electrode 27 are brought into contact against the electrical connecting portion with an impact force in the inserting direction of the ink cartridge 20. Therefore, the impact received by the pad electrode 27 and the electrical connecting portion 22 can be reduced.

Embodiment 4

Also in Embodiment 4, the plurality of pad electrodes move in a direction away from the side surface of the casing of the ink cartridge and project from the side surface of the casing, so that the plurality of pad electrodes can be electrically connected to the electrical connecting portion. In the following, the description will be made mainly on the points different from the foregoing embodiments.

Figure 17:
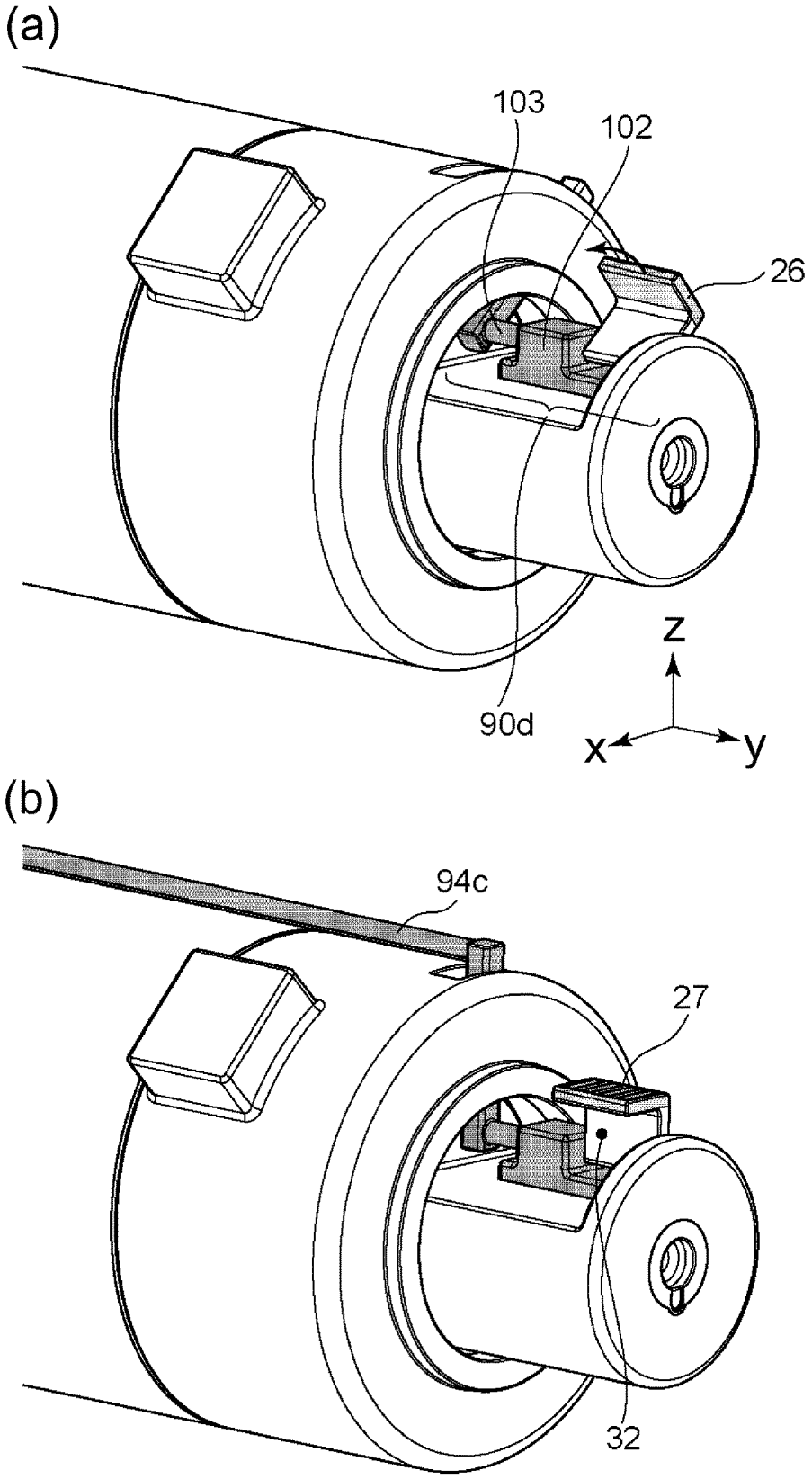
FIG. 17 is an illustration showing how the pad electrodes move.
Figure 19:
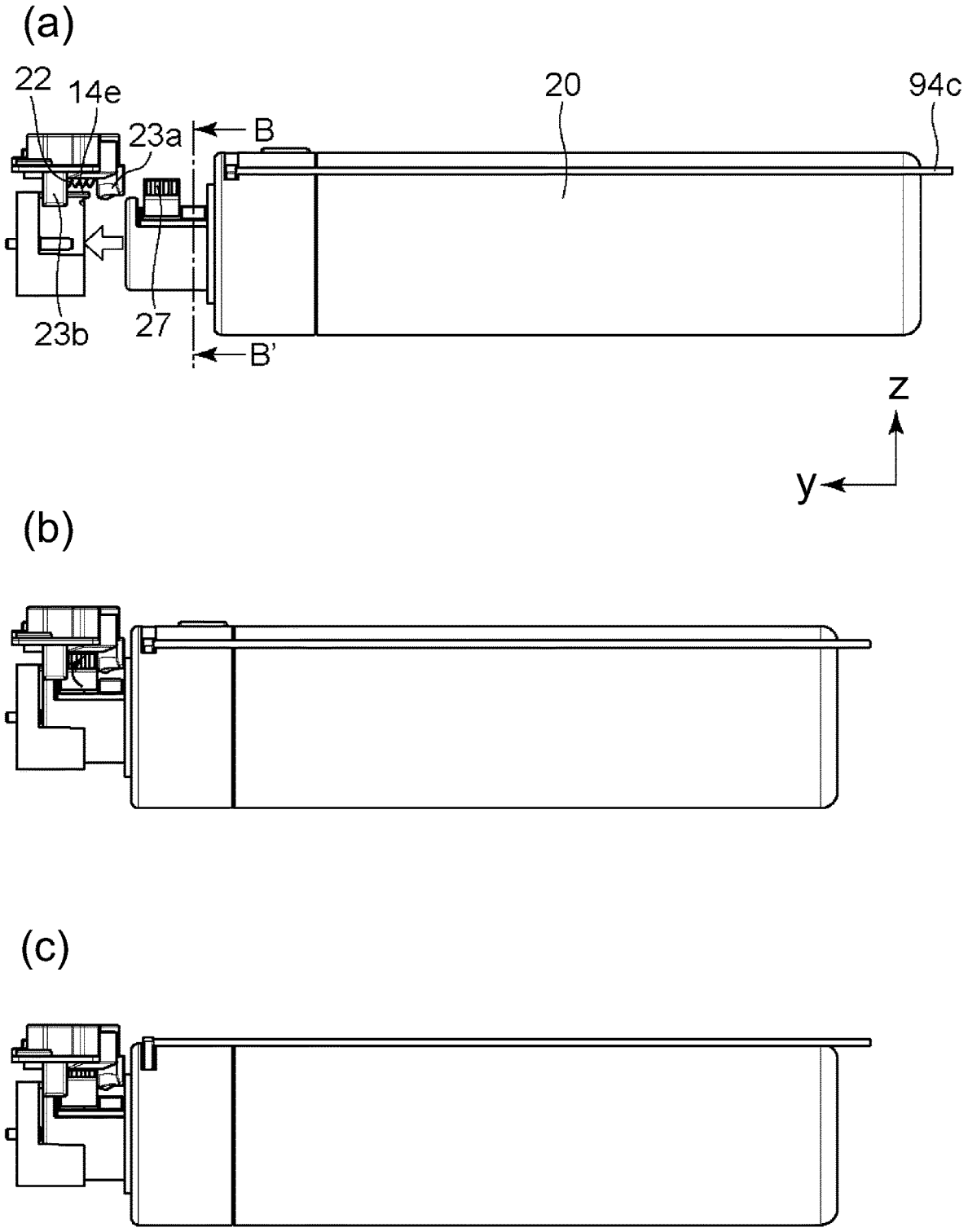
FIG. 19 is an illustration of how the ink cartridge is mounted.

As shown in FIG. 19, the ink cartridge 20 of Embodiment 4 is not divided into two members. The ink cartridge 20 includes a large diameter portion and a small diameter portion. Part (a) of FIG. 17 is an illustration showing a state before the ink cartridge is mounted on the mounting portion. An electrode unit 90*d* is mounted to the small diameter portion of the ink cartridge casing. The electrode unit 90*d* includes a chip-shaped electrode portion 26 including a plurality of pad electrode 27 (part (b) of FIG. 17). The electrode unit 90*d* may be separated from the casing, but here, an integrated example is shown. The electrode unit 90*d* comprises a rotary shaft mounting base 102, the electrode portion 26, and an operation pin 94*c*. The electrode portion 26 is mounted to the rotary shaft mounting base 102, and the rotatable shaft 103 is provided on the electrode portion 26.

Part (b) of FIG. 17 illustrates the state in which the electrode portion 26 of the ink cartridge shown in part (a) of FIG. 17 is rotated. When the electrode portion 26 rotates, the plurality of pad electrode 27 which have been in the neighborhood of the side surface of the casing rise, move to a position away from the side surface of the casing, and come to a position projecting from the side surface of the casing. The plurality of pad electrode 27 which have moved are in a state where they can be electrically connected to the electrical connecting portion. There is a gap 32 below the electrode portion 26 and the pad electrode 27.

The rotation of the electrode portion 26 and the plurality of pad electrode 27 is performed using the operation pins 94*c*, for example. The mechanism in which the plurality of pad electrode 27 move away from the side surface of the casing as a result of the rotation and project from the side surface of the casing will be described in more detail. Part (a) in FIG. 17 shows a state before the pad electrode 27 move. In this state, even when the ink cartridge is inserted in the inserting direction (y direction), the pad electrode 27 are at such an angle that it cannot contact the electrical connecting portion 22.

The rotatable shaft 103 is connected to the operation pin 94*c* (part (b) of FIG. 17) so that by moving the operation pin 94*c* in the moving direction 115, the pad electrodes and the electrode portion 26 also rotate in the moving direction 115. The pad electrodes and electrode portion 26 may be rotated by means other than the operation pin 94*c*. It is preferable that the rotation angle is 45 degrees or more and 90 degrees or less in consideration of the volume efficiency of the ink cartridge and user operability.

Figure 18:
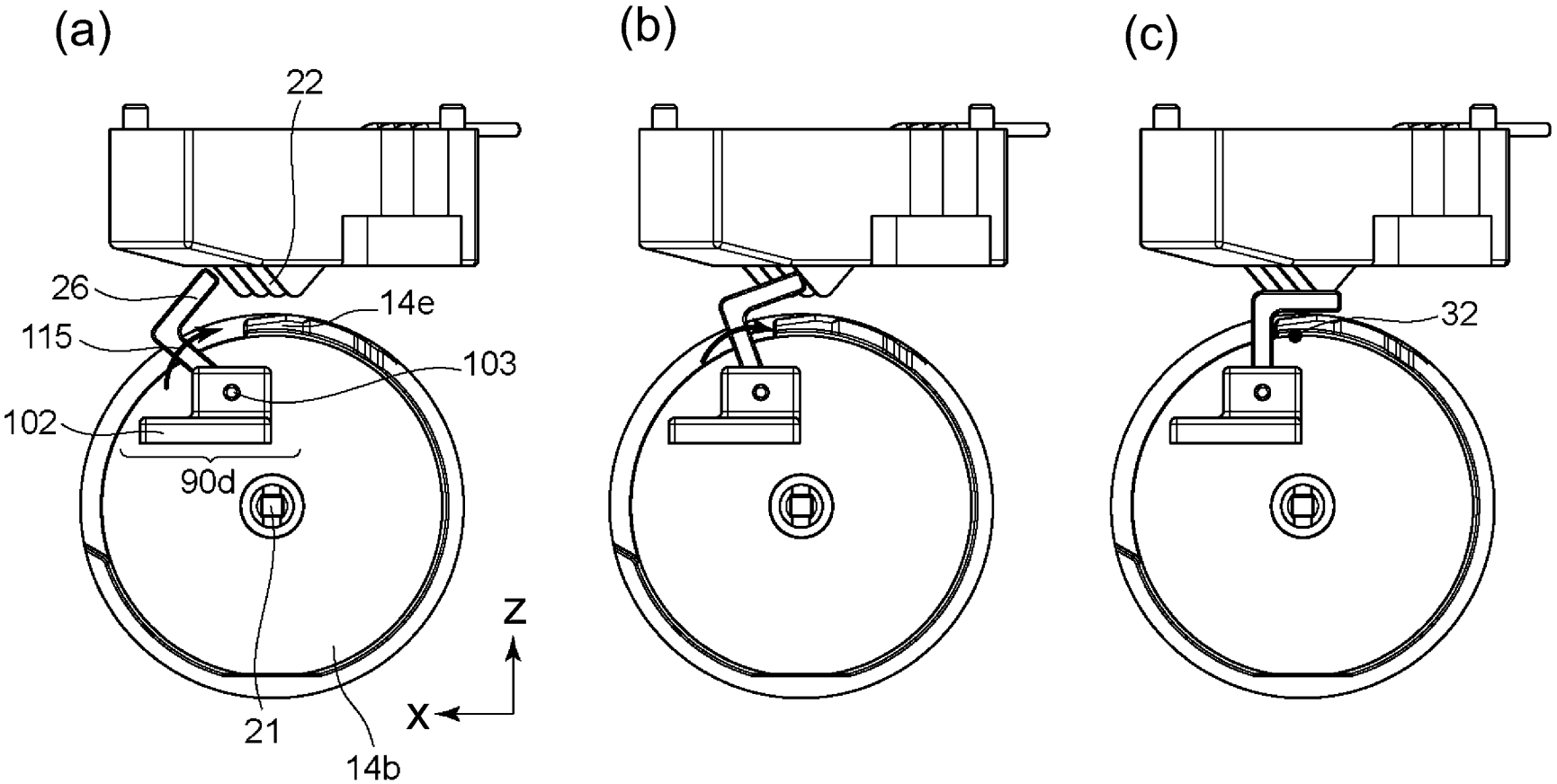
FIG. 18 is an illustration showing how the pad electrodes move.

FIG. 18 shows a state in which the plurality of pad electrode 27 move in a direction away from the side surface of the casing and project from the side surface of the casing. Part (a) of FIG. 18 shows a state in which the pad electrode 27 start to move. When the pad electrode 27 rotate and move, the state becomes as shown in part (b) of FIG. 18 and part (c) of FIG. 18, so that it becomes capable of electrically connecting with the electrical connecting portion.

Figure 20:
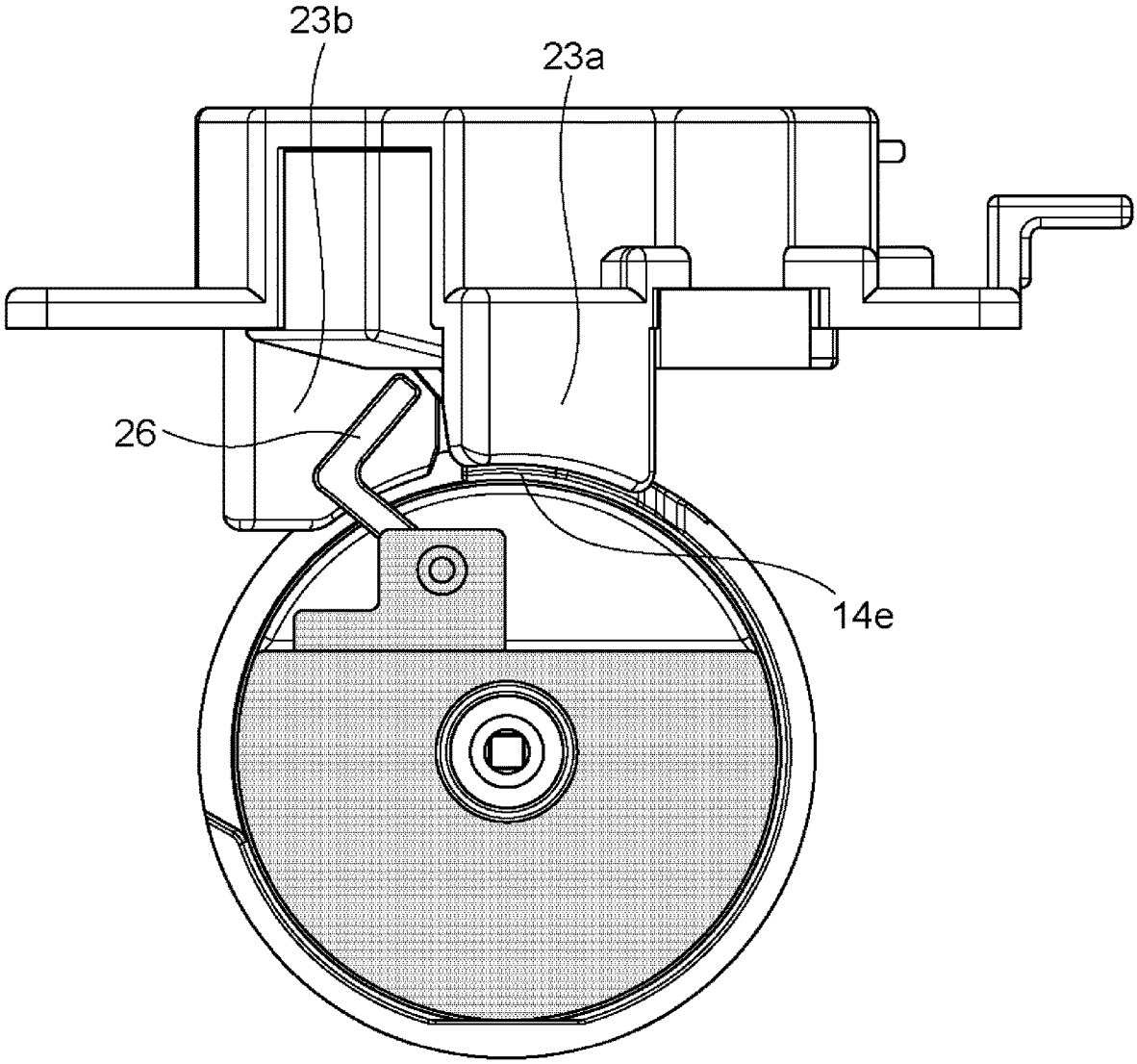
FIG. 20 is an illustration showing a structure around the electrical connecting portion of the mounting portion.

Referring to FIG. 19 the overall structure for mounting the ink cartridge 20 will be described. Part (a) of FIG. 19 is an illustration of a state before the pad electrodes move. Positioning walls 23*a* and 23*b* and a support member 14*e* are provided on the mounting portion side. FIG. 20 is a cross-sectional view taken along line BB' of part (a) of FIG. 19. As shown in FIG. 20, even when the ink cartridge 20 is inserted in the inserting direction (+y direction), the electrode portion 26 is at such an angle position that it does not contact the positioning walls 23*a* and 23*b* and the support member 14*e*.

After inserting the ink cartridge 20, as shown in part (b) of FIG. 19, the electrode portion 26 including the pad electrodes is rotated about the rotatable shaft 103 (FIGS. 17 and 18) to be moved to a position where it can be connected to the electrical connecting portion 22. In this state, the pad electrodes are not electrically connected to the electrical connecting portion 22.

Next, as shown in part (c) of FIG. 19, the pad electroded and electrode portion 26 are rotated in the moving direction 115 by the operation pin 94*c*, so that the electrical connecting portion 22 and the pad electrode 27 can be electrically connected. At this time, the support member 14*e* is inserted into the gap 32 (part (b) of FIG. 17). By inserting the support member 14*e* into the gap 32, the electrical connection is further stabilized.

Embodiment 5

Also in Embodiment 5, the plurality of pad electrodes move in a direction away from the side surface of the casing of the ink cartridge and project from the side surface of the casing, so that the plurality of pad electrodes can be electrically connected to the electrical connecting portion. In the following, the description will be made mainly on the differences from each embodiment.

Figure 21:
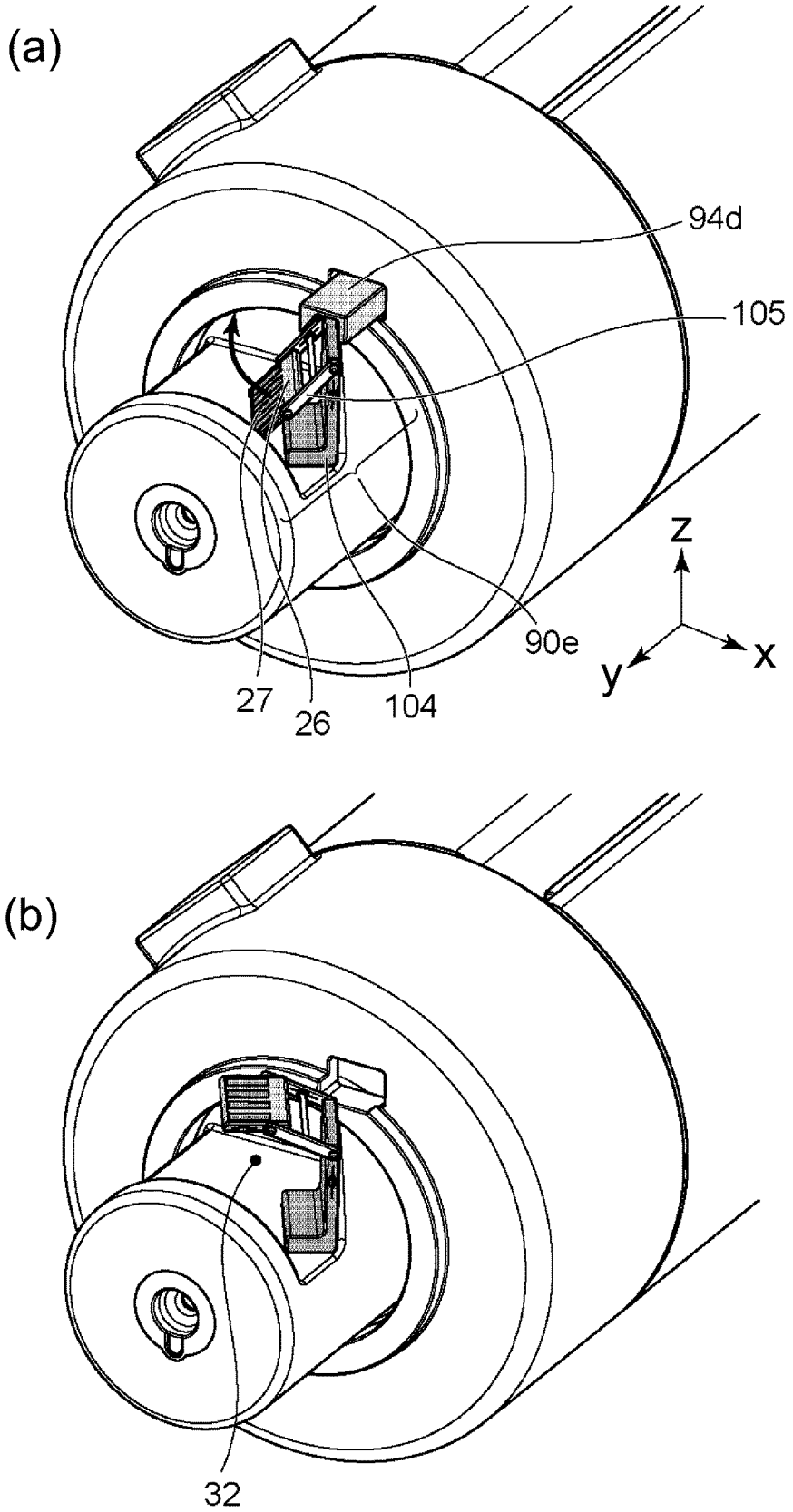
FIG. 21 is an illustration showing how the pad electrodes move.
Figure 23:
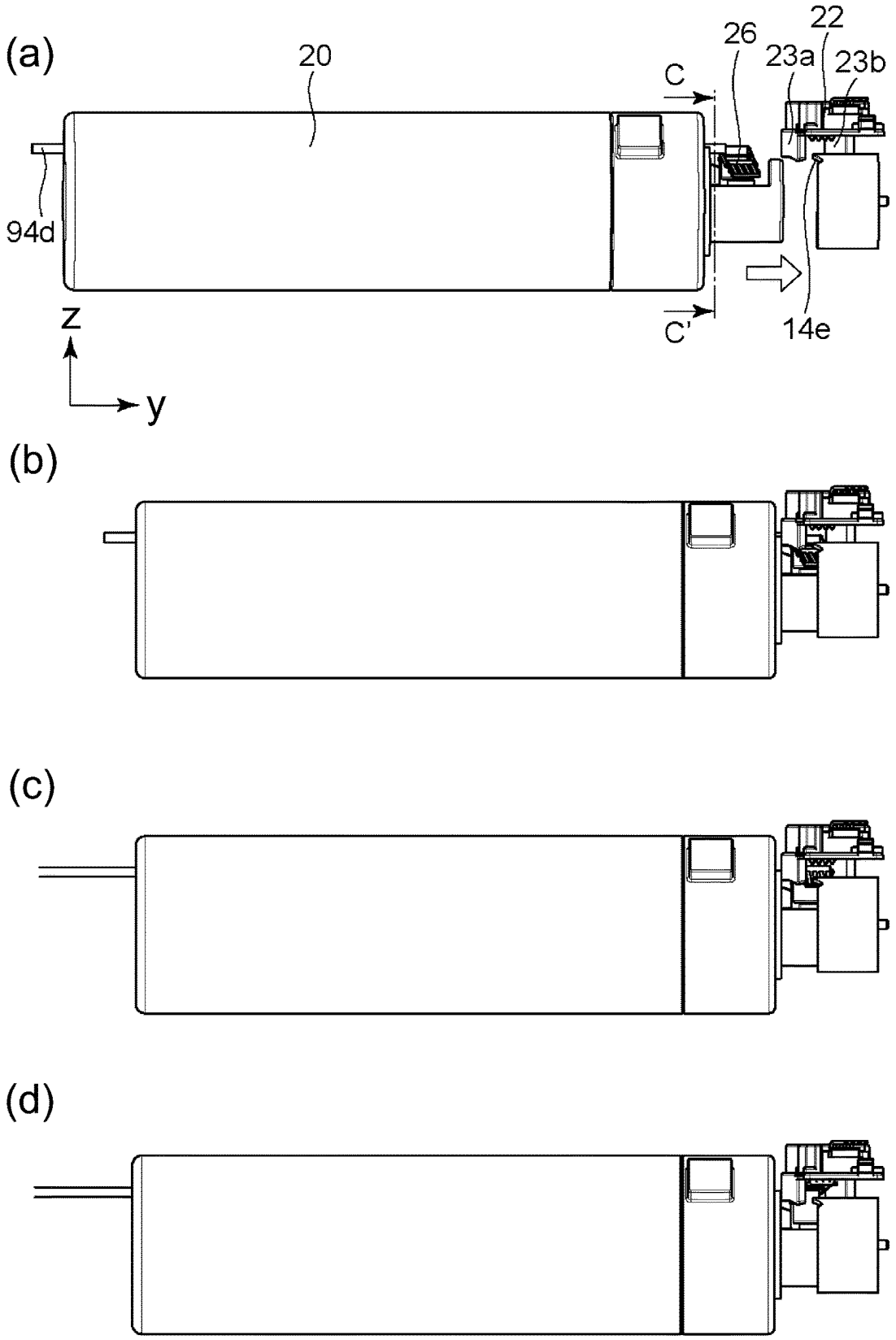
FIG. 23 is an illustration of how the ink cartridges mounted.
Figure 24:
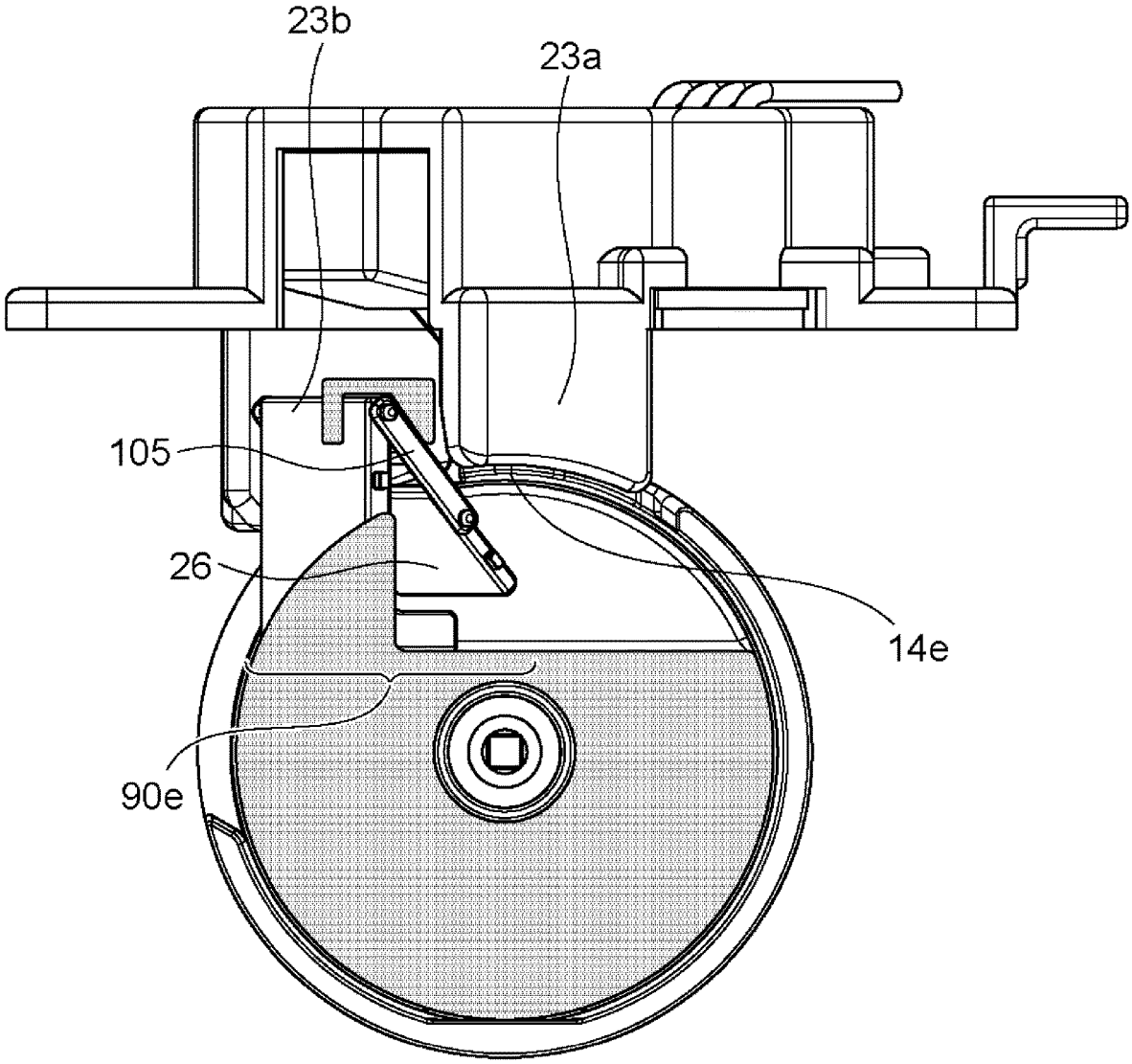
FIG. 24 is an illustration showing a structure around the electrical connecting portion of the mounting portion.

As shown in FIG. 23, the ink cartridge 20 of Embodiment 5 is not divided into two members. The ink cartridge 20 includes a large diameter portion and a small diameter portion. Part (a) of FIG. 21 is an illustration showing a state before the ink cartridge is mounted on the mounting portion. An electrode unit 90*e* is mounted to the small Than the diameter portion of the ink cartridge casing. The electrode unit 90*e* includes a chip-shaped electrode portion 26 including a plurality of pad electrode 27. The electrode unit 90*e* may be separated from the casing, but here, an integrated example is shown. The electrode unit 90*e* includes an electrode unit fixing base 104, the electrode portion 26, a connecting portion 105, an operation pin 94*d*, a first urging spring 107, and a second urging spring 108. The connecting portion 105 can rotate around the first shaft 109, and the electrode portion 26 can rotate around the second shaft 110. Part (b) of FIG. 21 illustrates the state in which the electrode portion 26 of the ink cartridge shown in part (a) of FIG. 21 is rotated. When the electrode portion 26 rotates, the plurality of pad electrode 27 placed adjacent to the side surface of the casing move to a position away from the side surface of the casing to a position projecting from the side surface of the casing. The plurality of pad electrode 27 which have moved became in a state that they can be electrically connected to the electrical connecting portion. There is a gap 32 below the electrode portion 26 and the pad electrode 27.

Figure 22:
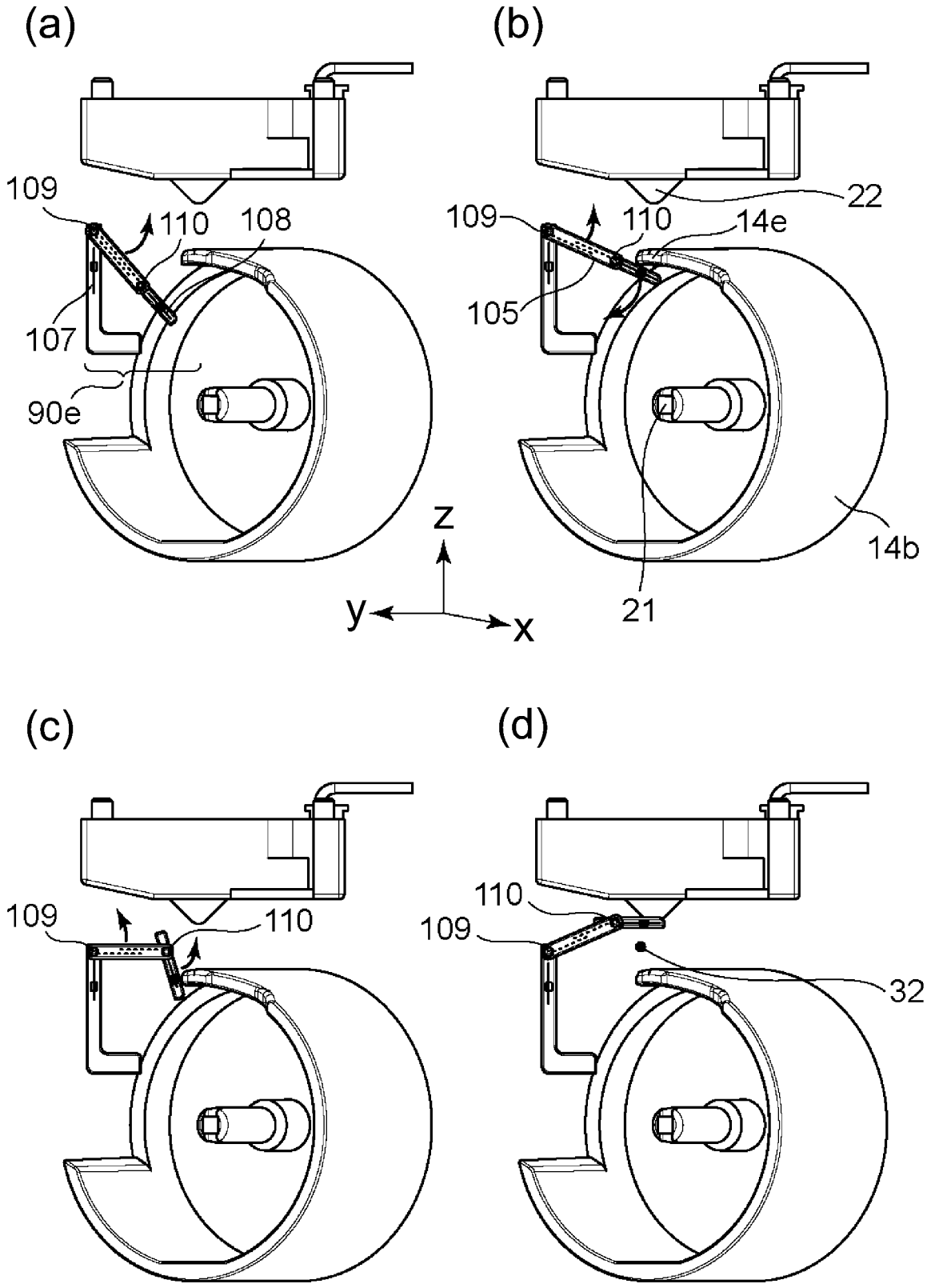
FIG. 22 is an illustration showing how the pad electrodes move.

Parts (a) to (d) of FIG. 22 show how the pad electrodes move by rotation. In the state shown in part (a) of FIG. 22, the electrode unit fixing base 104 and the connecting portion 105 are fixed in a state of being folded by the operation pin 94*d* (FIG. 21). In this state, even when the ink cartridge is inserted in the inserting direction (+y direction), the pad electrode 27 is fixed at such an angle that it cannot contact the electrical connecting portion 22. In addition, the pad electrode 27 is fixed in a state the stress is applied to the first urging spring 107.

As shown in part (b) of FIG. 22, when the operation pin 94*d* (FIG. 21) is pulled out, the connecting portion 105 and the electrode portion 26 move upward by the reaction force of the first urging spring 107. And, a support member 14*e* is disposed in the course of the movement, and therefore, the electrode portion 26 contacts the support member 14*e*.

As shown in part (c) of FIG. 22, the connecting portion 105 is raised while rotating about the first shaft 109 by the reaction force of the first urging spring 107. On the other hand, the electrode portion 26 advances over the support member 14*e* in a state of being folded with the connecting portion 105 by contacting the support member 14*e*. At this time, the second urging spring 108 is stressed by the electrode portion 26 being folded.

Next, as shown in part (d) of FIG. 22, when the electrode portion 26 has advanced over the support member 14*e*, the electrode portion 26 returns to the original state by the reaction force of the second urging spring 108. And, the pad electrode 27 provided in the electrode portion 26 and the electrical connecting portion 22 become in a state the they can be electrically connected. In addition, if the reaction force of the second urging spring 108 remains in the electrically connectable state, the electrical connection can be made more stable.

Here, in the above-described example, the moving method of the pad electrode 27 employees the biasing spring, but it may be carried out using power other than by the spring.

Referring to FIG. 23, the overall structure for mounting the ink cartridge 20 will be described. Part (a) of FIG. 23 is an illustration of a state before the pad electrodes move. Positioning walls 23*a* and 23*b* and a support member 14*e* are provided on the mounting portion side. The 24 is a cross-sectional view taken along the line CC' of part (a) of FIG. 23, and shows the positional relationship of the electrode portion 26, the positioning walls 23*a* and 23*b*, and the support member 14*e* before the ink cartridge 20 is inserted. As shown in FIG. 20, even when the ink cartridge 20 is inserted in the inserting direction (+y direction), the electrode portion 26 is disposed at such an angle that it does not contact the positioning walls 23*a* and 23*b* and the support member 14*e*.

The state where the ink cartridge 20 of part (a) of FIG. 23 is inserted in the inserting direction (+y direction) is part (b) of Figure.

Part (b) of FIG. 23 shows a state where the ink cartridge 20 of part (a) of FIG. 23 is inserted in the inserting direction (+y direction). In the state of part (b) in FIG. 23, the connecting portion 105 and the electrode portion 26 are electrically connected to the electrical connecting portion 22 by rotating around the first shaft 109 and the second shaft 110 (FIG. 22). The ink cartridge 20 is inserted up to a position where it can be connected to. In the state of part (b) in FIG. 23, the ink cartridge 20 is inserted to such a position that it can be connected to the connecting portion 105 and the electrode portion 26 are electrically connected to the electrical connecting portion 22, by rotating around the first shaft 109 and the second shaft 110 (FIG. 22). In this state, it is not yet in the state that it can be electrically connected to the electrical connecting portion 22.

Next, as shown in part (c) of FIG. 23 and part (d) of FIG. 23 by pulling out the operation pin 94*d*, the electrode portion 26 is moved by the rotating operation. Part (d) of FIG. 23 is an illustration showing a state in which the electrical connecting portion 22 and the pad electrode 27 can be electrically connected.

Embodiment 6

In Embodiments 1-5, the member which can be mounted to the mounting portion has been an ink container or an ink cartridge containing ink. However, the present invention is not limited to such an example, and the member may not contain ink. For example, the ink container or cartridge shown in each embodiment may be a member not contain ink. And, this member is moved to move the pad electrodes as described in each embodiment. Thereafter, a member containing the ink or a tube for supplying the ink may be mounted to the member mounted in the mounting portion.

INDUSTRIAL APPLICABILITY

According to the present invention, there is provided an ink cartridge adapter, an ink cartridge and so on including a casing; and a plurality of pad electrodes mounted on the casing so as to be movable in a direction outwardly away from a side surface of the casing member.

While the present invention has been described with reference to exemplary embodiments, it is to be understood that the invention is not limited to the disclosed exemplary embodiments. The scope of the following claims is to be accorded the broadest interpretation so as to encompass all such modifications. And equivalent structures and functions.

This application claims the benefit of Japanese Patent Application No. 2018-184604 filed on Sep. 28, 2018, which is hereby incorporated by reference herein in its entirety.

The invention claimed is:

1. An ink cartridge adapter comprising:

a casing having a first portion facing outwardly, a second portion on an opposite side of said first portion, and a third portion connecting said first portion and said second portion with each other; and a plurality of pad electrodes mounted on said third portion of said casing so as to be movable in a direction outwardly away from a side surface of said casing.

2. A recording apparatus comprising an ink cartridge adapter according to claim 1.

3. An ink cartridge adapter according to claim 1, further comprising a push-up plate configured to push up said pad electrodes to move said pad electrodes outwardly away from said side surface of said casing.

4. An ink cartridge adapter according to claim 3, further comprising a first member and a second member, wherein said second member is capable of being inserted into said first member to push said push-up plate, thus moving said pad electrodes outwardly away from said side surface of said casing.

5. An ink cartridge adapter according to claim 1, further comprising:

an urging spring configured to urge said pad electrodes; and an operation pin configured to change positions of said pad electrodes, wherein by said urging spring and said operation pin, said pad electrodes are moved outwardly away from said side surface.

6. An ink cartridge adapter according to claim 1, wherein said adapter is provided with an inclined surface inclined relative to a longitudinal direction of said side surface, and wherein by the movement of said pad electrodes along said inclined surface, said pad electrodes are moved outwardly away from said side surface.

7. An ink cartridge adapter according to claim 1, wherein by rotating said pad electrodes, said pad electrodes are moved outwardly away from said side surface.

8. An ink cartridge adapter comprising:

a casing;

a plurality of pad electrodes mounted on said casing so as to be movable in a direction outwardly away from a side surface of said casing;

a push-up plate configured to push up said pad electrodes to move said pad electrodes outwardly away from said side surface of said casing; and a first member and a second member, wherein said second member is capable of being inserted into said first member to push said push-up plate, thus moving said pad electrodes outwardly away from said side surface of said casing.

9. An ink cartridge adapter comprising:

a casing;

a plurality of pad electrodes mounted on said casing so as to be movable in a direction outwardly away from a side surface of said casing;

an urging spring configured to urge said pad electrodes; and an operation pin configured to change positions of said pad electrodes, wherein by said urging spring and said operation pin, said pad electrodes are moved outwardly away from said side surface.

10. An ink cartridge adapter comprising:

a casing; and a plurality of pad electrodes mounted on said casing so as to be movable in a direction outwardly away from a side surface of said casing, wherein by rotating said pad electrodes, said pad electrodes are moved outwardly away from said side surface.

* * * * *